US009370755B2

(12) United States Patent
Kamiya

(10) Patent No.: US 9,370,755 B2
(45) Date of Patent: Jun. 21, 2016

(54) PARTICLE SIZE BREAKUP APPARATUS HAVING BLADE-SUPPORTED ROTOR

(75) Inventor: Tetsu Kamiya, Odawara (JP)

(73) Assignee: MEIJI CO., LTD., Koutou-Ku, Tokyo (JP)

( * ) Notice: Subject to any disclaimer, the term of this patent is extended or adjusted under 35 U.S.C. 154(b) by 60 days.

(21) Appl. No.: 14/239,565

(22) PCT Filed: Aug. 16, 2012

(86) PCT No.: PCT/JP2012/070841
§ 371 (c)(1),
(2), (4) Date: Feb. 20, 2014

(87) PCT Pub. No.: WO2013/027650
PCT Pub. Date: Feb. 28, 2013

(65) Prior Publication Data

US 2014/0192614 A1 Jul. 10, 2014

(30) Foreign Application Priority Data

Aug. 19, 2011 (JP) ..... 2011-179734

(51) Int. Cl.
*B01F 7/16* (2006.01)
*B01F 7/00* (2006.01)
*B01F 5/10* (2006.01)

(52) U.S. Cl.
CPC ..... *B01F 7/0075* (2013.01); *B01F 5/10* (2013.01); *B01F 7/00833* (2013.01); *B01F 7/162* (2013.01); *B01F 7/164* (2013.01)

(58) Field of Classification Search
CPC .... B01F 7/0075; B01F 7/008; B01F 7/00808; B01F 7/00816; B01F 7/00833; B01F 7/00358; B01F 5/104; B01F 7/164; B01F 2215/0404; B01F 2215/0409; B01F 5/165; G01M 13/00
USPC ..... 366/264, 302, 304, 305, 286
See application file for complete search history.

(56) References Cited

U.S. PATENT DOCUMENTS 1,757,065 A * 5/1930 Warsop ..... B01F 5/066 366/263
1,873,199 A * 8/1932 Haskell ..... 241/259.1

(Continued)

FOREIGN PATENT DOCUMENTS

JP 5-26138 U 4/1993
JP 8-504663 A 5/1996

(Continued)

OTHER PUBLICATIONS

Barailler, F. et al., "CFD Analysis of a Rotor-Stator Mixer With Viscous Fluids", Chemical Engineering Science, vol. 61, pp. 2888-2894 (2006).

(Continued)

*Primary Examiner* — Charles Cooley
(74) *Attorney, Agent, or Firm* — Buchanan Ingersoll & Rooney PC

(57) ABSTRACT

A rotor/stator type mixer implements the particle size breakup apparatus and includes a stator having a plurality of openings formed thereon and a rotor disposed on the inside of the stator and spaced away from the stator with a specific gap. The rotor, which is disposed inwardly of the stator having the plurality of openings formed thereon so that it can be spaced away from the stator with the specific gap, has a rotor peripheral wall that faces opposite the inside of the stator peripheral wall and is disposed inwardly radially of the peripheral wall of the stator having the plurality of openings formed thereon so that it can be spaced away from the stator with the specific gap. In addition, the rotor has a plurality of openings formed thereon.

15 Claims, 28 Drawing Sheets

(56) References Cited

U.S. PATENT DOCUMENTS

| | | | | | |
|---|---|---|---|---|---|
| 1,997,032 | A * | 4/1935 | Alstad et al. | 99/453 |
| 2,169,339 | A * | 8/1939 | Ditto | 366/305 |
| 2,591,966 | A * | 4/1952 | Rider | 366/286 |
| 3,194,540 | A * | 7/1965 | Hager | 366/305 |
| 3,195,867 | A * | 7/1965 | Mould, Jr. | 366/305 |
| 3,224,689 | A * | 12/1965 | Behrens et al. | 241/244 |
| 3,514,079 | A * | 5/1970 | Little, Jr. | 366/305 |
| 3,658,266 | A * | 4/1972 | O'Keefe et al. | 241/101.2 |
| 3,982,700 | A * | 9/1976 | Love | 241/46.11 |
| 5,088,831 | A * | 2/1992 | Reinhall | 366/171.1 |
| 5,590,961 | A | 1/1997 | Rasmussen | |
| 5,902,042 | A * | 5/1999 | Imaizumi et al. | 366/176.2 |
| 6,000,840 | A * | 12/1999 | Paterson | 366/264 |
| 8,851,741 | B2 * | 10/2014 | Ganmor et al. | 366/171.1 |
| 8,911,141 | B2 * | 12/2014 | De Oliveira et al. | 366/164.6 |
| 8,960,993 | B2 * | 2/2015 | De Oliveira et al. | 366/139 |
| 2003/0152500 | A1 * | 8/2003 | Dalziel et al. | 422/245.1 |
| 2004/0187770 | A1 * | 9/2004 | Calabrese et al. | 117/200 |
| 2004/0242764 | A1 | 12/2004 | Yamada et al. | |
| 2005/0242218 | A1 | 11/2005 | Nakano et al. | |
| 2011/0026358 | A1 * | 2/2011 | De Oliveira et al. | 366/139 |
| 2012/0093906 | A1 * | 4/2012 | Ganmor et al. | 424/405 |
| 2013/0215711 | A1 * | 8/2013 | Kamiya | 366/343 |
| 2013/0218348 | A1 * | 8/2013 | Kamiya | 700/275 |
| 2013/0226521 | A1 * | 8/2013 | Kamiya | 702/182 |
| 2013/0315026 | A1 * | 11/2013 | De Oliveira et al. | 366/134 |
| 2014/0192614 | A1 * | 7/2014 | Kamiya | 366/302 |
| 2015/0306553 | A1 * | 10/2015 | Kamiya | B01F 5/104 426/656 |

FOREIGN PATENT DOCUMENTS

| | | | |
|---|---|---|---|
| JP | 10-226981 | A | 8/1998 |
| JP | 2000-218153 | A | 8/2000 |
| JP | 2002-66284 | A | 3/2002 |
| JP | 2004-2732 | A | 1/2004 |
| JP | 2004-8898 | A | 1/2004 |
| JP | 2005-50617 | A | 2/2005 |
| WO | WO 94/13395 | A1 | 6/1994 |
| WO | WO 2012/023609 | A1 | 2/2012 |

OTHER PUBLICATIONS

Bourne, J. R. et al., "Fast Reactions in Rotor-Stator Mixers of Different Size", Chemical Engineering and Processing, vol. 31, pp. 285-296 (1992).

Calabrese, R.V. et al., "Measurement and Analysis of Drop Size in a Batch Rotor-Stator Mixer", Proc. 10th European Conference on Mixing, pp. 149-156 (2000).

Calabrese, R.V. et al., "Fluid Dynamics and Emulsification in High Shear Mixers", Pro. 3rd World Congress on Emulsions, pp. 1-10 (2002).

Davies, J.T., "Drop Sizes of Emulsions Related to Turbulent Energy Dissipation Rates", Chemical Engineering Science, vol. 40, No. 5, pp. 839-842 (1985).

Davies, J.T., "A Physical Interpretation of Drop Sizes in Homogenizers and Agitated Tanks, Including the Dispersion of Viscous Oils", Chemical Engineering Science, vol. 42, No. 7, pp. 1671-1676 (1987).

Kowalski, A. J., "An Expression for the Power Consumption of In-Line Rotor-Stator Devices", Chemical Engineering and Processing, vol. 48, pp. 581-585 (2009).

Maa, Y-F. et al., "Liquid-Liquid Emulsification by Rotor/Stator Homogenization", Journal of Controlled Release, vol. 38, pp. 219-228 (1996).

Porcelli, J., "The Science of Rotor/Sator Mixers", Food Processing, vol. 63, pp. 60-66 (Feb. 2002).

Utomo, A. T. et al., "Flow Pattern, Periodicity and Energy Dissipation in a Batch Rotor-Stator Mixer", Chemical Engineering Research and Design, vol. 86, pp. 1397-1409 (2008).

Yamaguchi, I., "Mixing and Agitating", Bessatsu Kagaku Kogyo, vol. 28, pp. 11-18 (1984).

Bourne, J. R. et al., "Rotor-Stator Mixers for Rapid Micromixing", Chemical Engineering Research and Design, vol. 64, pp. 11-17 (1986).

Urban, K. et al., "Rotor-Stator and Disc Systems for Emulsification Processes", Chem. Eng. Technol. vol. 29, No. 1, pp. 24-31 (2006).

Kamiwano, M.K. et al., "Mixing Performance of Various Agitators", Chem. Eng., vol. 31, pp. 365-372 (1967).

International Search Report (PCT/ISA/210) mailed on Oct. 16, 2012, by the Japanese Patent Office as the International Searching Authority for International Application No. PCT/JP2012/070841.

* cited by examiner

PRIOR ART

External Circulation

PRIOR ART

Internal Circulation

PRIOR ART

Mixer (Rotor-Stator Type)

PRIOR ART

PRIOR ART

Relationship between Processing (Mixing) Time and Resulting Drop Diameter for Mixers A-1 and A-2

Relationship between Mean Resulting Drop Diameter and Total Energy Dissipation Rate for Mixer A-1 and A-2

○ Lab, $u = 27$ m/s, $\delta = 0.25$mm

△ Lab, $u = 21$ m/s, $\delta = 0.25$mm

● MP10, $u = 25$ m/s, $\delta = 0.25$mm

▲ MP10, $u = 20$ m/s, $\delta = 0.25$mm

Relationship between Mean Resulting Drop Diameter and Total Energy Dissipation Rate for Mixer B Effect of Gap on Particle Size Breakup Effect Effect of Hole Diameter of Opening Portion on Particle Size Breakup Effect Effect of Number of Holes (Opening Area Ratio) on Particle Size Breakup Effect Performance Improvement Effect of Existing Relationship between Mixing Time and Drop Diameter under Running Condition for Mixer C in Table 8

Relationship between Average Liquid Drop Diameter and Total Energy Dissipation Rate for Mixer C (Stators No. 1 to No.5)

Relationship between Mean Drop Diameter and Total Energy Dissipation Rate for Mixers D and E Relationship between Mixing Time and Average Liquid Drop Diameter Relationship between Mixing Time and Standard Deviation Relationship between Number of Rotations and Average Liquid Drop Diameter Relationship between Number of Rotations and Standard Deviation (a)

Relationship between Number of Rotations and Flow Rate (b)

Relationship between Number of Rotations and Drive Power (c)

Relationship between Number of Rotations and Emulsify Contribution Power

Relationship between Mixing Time and Average Liquid Drop Diameter

PARTICLE SIZE BREAKUP APPARATUS HAVING BLADE-SUPPORTED ROTOR

BACKGROUND

1. Technical Field

In general, the present invention provides a particle size breakup apparatus. More particularly, the present invention relates to a mixer that implements the particle size breakup apparatus and includes a stator having a plurality of openings formed thereon and a rotor disposed inwardly of the stator and spaced away from the stator with a specific gap, that is, the so-called rotor/stator type mixer.

2. Description of the Prior Art

Generally, it is shown in FIG. 1 that the so-called rotor/stator type mixer comprises a mixer unit 4 that includes a stator 2 having a plurality of openings 1 formed thereon and a rotor 3 disposed inwardly of the stator 2 and spaced away from the stator 2 with a specific gap δ. This so-called rotor/stator type mixer provides the emulsifying, dispersing, particle size breaking up, mixing and any other processing facilities for a fluid or liquid (referred to hereinafter as "fluid) being processed, by taking advantage of the high shearing stress that may be produced in the neighborhood of the gap between the rotor 3 rotating at high speeds and the stator 2 in its fixed position, and may be widely used for mixing and preparing the fluid or liquid being processed in the manufacturing fields such as the foods, pharmaceutical medicines, chemical products and other like industries.

The rotor/stator type mixer may be divided into the two classes, such as the external circulation mode mixer that allows the fluid being processed to circulate as indicated by an arrow 5*a* in FIG. 2 and the internal circulation mode mixer that allows the fluid being processed to circulate as indicated by an arrow 5*b* in FIG. 2.

The rotor/stator type mixer is now available in the various forms and circulation modes. For example, the Patent Document 1 (the apparatus for and method of producing particles using the combination of the rotor and stator) proposes an apparatus for and method of producing particle sizes that may be applied to produce those particles, in which the mixer includes the stator having a plurality of openings formed thereon and the rotor disposed inwardly of the stator and spaced away from the stator with a specific gap, and may be widely used for manufacturing the pharmaceutical medicines, nutritious supplement foods, chemical products, cosmetics and the like. It is described that the mixer can be scaled up in the effective, simple and easy manner.

There are several indexes (theories) that have been reported heretofore as the methods for estimating the performances for the mixers of the various forms and types.

For example, when the attention is focused on the liquid-to-liquid dispersion operation as well as the rotor/stator type mixer discussed above, it is reported that the sizes for the resulting liquid drop diameters can be discussed in terms of the calculated values (greater or smaller) for the average energy dissipation rate (Non-Patent Documents 1 and 2), but it is not apparent from those Non-Patent documents 1 and 2 that the method for calculating the average energy dissipation rate is available.

There are several reports that describe the study cases in which the experiment results have been arranged so that those experiment results can be applied to individual misers (Non-Patent Documents 3 to 6). In those study cases (Non-Patent Documents 3 to 6), however, the particle size breakup effect for the mixer has only been discussed in terms of the effect of the gap on the rotor and stator, the effect of the openings (holes) on the stator, and the like. What has been reported in those study cases is different for each individual mixer.

There are also several reports that describe the study cases in which the particle size breakup mechanism for the rotor/stator type mixer is discussed (Non-Patent Documents 7 and 8). It is suggested in those documents that the particle size breakup effect for the resulting liquid drop diameters may be promoted by the energy dissipation rate for the turbulent flow and may be affected by the frequency with which the liquid being processed is subjected to the shearing stress (shearing frequency).

For the scale-up method for the rotor/stator type mixer, there are several reports in which the final resulting liquid drop diameters (the most stable resulting liquid drop diameters) that can be obtained by running the mixer for a long time are discussed (Non-Patent Document 9). However, the scale-up method is not practical on the actual manufacturing plants, and so it is not useful. Even if it is assumed that the mixer's processing time is considered and the resulting liquid drop diameters are estimated, what is reported is only the phenomena (facts) that are simply based on the actually measured values (experiment values). The report does not describe the study case in which the resulting liquid drop diameters are analyzed theoretically.

Although the Patent Document 1 mentioned above describes the superiority (performance) of a particular type mixer and presents the numerical value ranges for designing such particular type mixer, the numerical ranges for designing the high performance mixer and the theoretical grounds on which the numerical value ranges are based are not described specifically. The information on the types and forms of the high performance mixer is not disclosed.

As described above, several indexes (theories) that provide the basis for the performance estimation method for the mixers of the various types or forms have been reported. It should be noted, however, that in many cases, those indexes can only be applied to the individual mixers of the same type or form. In most cases, actually, those indexes cannot be applied to the various type mixers each having a different form. For example, although there may be indexes that can only be applied to those mixers in which the gap between the rotor and the stator has a great effect on the particle size breakup or there may be indexes that can only be applied to those mixers in which the openings (holes) formed on the stator have a great effect on the resulting particle size breakup, the comprehensive indexes that can be applied to all of the mixers of all possible types or forms have not been discussed, and it is not considered that the indexes can be applied to all of the mixers of all possible types or forms.

It may be apparent from the above description that there are no study cases in which the performance estimation method and the scale-up method for the rotor/stator type mixers have been discussed. In addition, there are no study cases in which the indexes that can be applied to all of the various type mixers each having a different form have been discussed and in which the experiment results that are thus obtained have been arranged in any appropriate order.

In the prior art and in most cases, the performance estimation method and the scale-up method for the rotor/stator type mixers are estimated (1) for each individual mixer, (2) by using the small-scale machine, (3) for the resulting liquid drop diameters (most stable resulting liquid drop diameters) obtained during the long running time. In other words, it should be noted that in the prior art, the resulting liquid drop diameters that can be obtained (A) for the various type mixers and (B) by employing the large-scale machine (on the actual manufacturing installation) (C) during the mixer's particular running time have not been evaluated nor estimated.

For example, although it may be admitted that there are the indexes that can only be applied to those mixers for which the size of the gap between the rotor and the stator has a great effect on the resulting particle size breakup or emulsification, or there are the indexes that can only be applied to those mixers for which the size or form of each of the openings (holes) formed on the stator has a great effect on the resulting particle size breakup or emulsification, the comprehensive indexes that can be applied to all of the mixers of all possible types and forms (the theories on which the various type mixers can be compared or estimated comprehensively or in the unified manner) were not discussed, and there were no indexes that consider the above comparison or estimation.

For the above reason, the mixers were actually estimated regarding their respective performances and designed (developed and fabricated accordingly while the mixers were being tested on the trial and error basis by using the actual fluid being processed.

PRIOR TECHNICAL DOCUMENTS

Patent Documents

Patent Document 1: Patent No. 2005-50617

Non-Patent Documents

Non-patent document 1: Davies, J. T. "Drop Sizes of Emulsions Related to Turbulent Energy Dissipation Rates", Chem. Eng. Sci., 40, 839-842 (1985)

Non-patent document 2: Davies, J. T. "A Physical Interpretation of Drop Sizes in Homogenizers and Agitated Tanks, Including the Dispersion of Viscous Oils". Chem. Eng. Sci., 42, 1671-1676 (1987)

Non-patent document 3: Calabrese, R. V., M. K. Francis, V. P. Mishra and S. Phongikaroon; "Measurement and Analysis of Drop Size in Batch Rotor-Stator Mixer", Proc. 10th European Conference on Mixing, pp. 149-156, Delft, the Netherlands (2000)

Non-patent document 4: Calabrese, R. V., M. K. Francis, V. P. Mishra, G. A. Padron and S. Phongikaroon; "Fluid Dynamics and Emulsification in High Shear Mixers", Proc. 3rd World Congress on Emulsions, pp. 1-10, Lyon, France (2002)

Non-patent document 5: Maa, Y. F., and C. Hsu; "Liquid-Liquid Emulsification by Rotor/Stator Homogenization", J. Controlled. Release, 38, 219-228 (1996)

Non-patent document 6: Barailler, F. M. Heniche and P. A. Tanguy; "CFD Analysis of a Rotor-Stator Mixer with Viscous Fluids", Chem. Eng. Sci., 61, 2888-2894 (2006)

Non-patent document 7: Utomo, A. T., M. Baker and A. W. Pacek; "Flow Pattern, Periodicity and Energy Dissipation in a Batch Rotor-Stator Mixer", Chem. Eng. Res. Des., 86, 1397-1409 (2008)

Non-patent document 8: Porcelli, J.; "The Science of Rotor/Stator Mixers", Food Process, 63, 60-66 (2002)

Non-patent document 9: Urban K.; "Rotor-Stator and Disc System for Emulsification Processes", Chem. Eng. Technol., 29, 24-31 (2006)

SUMMARY OF THE INVENTION

One object of the present invention is to provide a rotor/stator type mixer that includes a stator having a plurality of openings formed thereon and a rotor disposed inwardly of the stator and spaced away from the stator with a specific gap, wherein the mixer is capable of improving the shearing stress applied to a fluid being processed so that it can provide the higher performance and wherein the mixer is also capable of changing or adjusting the shearing stress applied to the fluid being processed as well as changing or adjusting the rate at which the fluid being processed is allowed to flow.

Another object of the present invention is to design the rotor/stator type mixer such that it can provide the higher performance as mentioned above, by taking advantage of the comprehensive performance estimation method that can be applied to all of the mixers operating on any appropriate circulation mode or having the various forms as well as the design method that takes into consideration the mixer's particular running condition (such as the processing time).

Still another object of the present invention is to provide a manufacturing method (particle size breaking-up method) of manufacturing foods, pharmaceutical medicines, chemical products and the like by using the high-performance mixers that are implemented by utilizing the performance estimation method and/or the design method mentioned above.

In order to accomplish the objects mentioned above,

The invention provides a rotor/stator type mixer comprising a mixer unit that includes a stator having a plurality of openings formed thereon and a rotor disposed inwardly radially of the stator and spaced away from the stator with a specific gap, wherein the rotor disposed inwardly radially of the stator and spaced away from the stator with the specific gap includes:

a rotor peripheral wall that faces opposite the inside of the peripheral wall of the stator having the plurality of openings formed thereon and is located inwardly radially of the stator with the specific gap; and a plurality of rotor openings formed on the peripheral wall.

The invention provides a rotor/stator type mixer wherein the stator includes a plurality of stators each having a different peripheral diameter and wherein the rotor peripheral wall of the rotor disposed inwardly radially of each of the stators is disposed so that it can be spaced away from each of the stators with a respective specific gap.

The invention provides a rotor/stator type mixer wherein the stator and the rotor are provided so that they can be brought closer to or farther away from each other in the direction in which the rotary shaft of the rotor extends.

The invention provides a rotor/stator type mixer wherein the stator has an annular cover extending inwardly radially from the edge of the top end edge.

The invention provides a rotor/stator type mixer wherein the annular cover has an inlet hole through which a fluid being processed can be introduced downwardly.

The invention provides a rotor/stator type mixer wherein each of the plurality of openings formed on the stator has a round shape.

The invention provides a rotor/stator type mixer wherein the plurality of openings formed on the stator represent over 20% of the total peripheral wall of the stator when it is expressed in terms of the opening-to-area ratio.

The invention provides a rotor/stator type mixer wherein the rotor has a plurality of agitating blades extending radially from the center point of the rotary shaft of the rotor.

The invention rovides a rotor/stator type mixer wherein the mixer is designed by calculating the Equation 1 listed below to estimate the mixer's particular running time and the resulting liquid drop diameters of the fluid being processed that are obtained during that mixer's particular running time, the mixer's design being such that it allows the resulting liquid drop diameters of the fluid being processed to be determined during the mixer's particular running time:

$$\varepsilon_a = \varepsilon_g + \varepsilon_s \qquad \text{Equation 1}$$

$$= [(N_p - N_{qd}\pi^2)\cdot n_r]\left\{D^3\left[\frac{\left(\frac{D^3 b}{\delta(D+\delta)}\right) + \frac{\pi^2 n_s^2 d^3(d+4\ell)}{4N_{qd}\left[\begin{matrix} n_s\cdot d^2 + \\ 4\delta(D+\delta)\end{matrix}\right]}}{}\right]\right\}\left(\frac{N^4\cdot t_m}{V}\right)$$

$$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b: Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

The invention provides a rotor/stator type mixer wherein the mixer can be scaled up or scaled down by calculating the Equation 1 listed below to estimate the mixer's particular running time and the resulting liquid drop diameters that can be obtained during that mixer's particular running time:

$$\varepsilon_a = \varepsilon_g + \varepsilon_s \qquad \text{Equation 1}$$

$$= [(N_p - N_{qd}\pi^2)\cdot n_r]\left\{D^3\left[\frac{\left(\frac{D^3 b}{\delta(D+\delta)}\right) + \frac{\pi^2 n_s^2 d^3(d+4\ell)}{4N_{qd}\left[\begin{matrix} n_s\cdot d^2 + \\ 4\delta(D+\delta)\end{matrix}\right]}}{}\right]\right\}\left(\frac{N^4\cdot t_m}{V}\right)$$

$$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b: Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

The invention provides foods, pharmaceutical medicines or chemical products that are manufactured by using the manufacturing method.

The present invention provides the advantages to be described below:

As one of the advantages, it may be understood that in the rotor/stator type mixer that includes the stator having the plurality of openings formed thereon and the rotor disposed inwardly of the stator and spaced away from the stator with the specific gap, the present invention proposes the mixer that is capable of improving the shearing stress applied to the fluid being processed so that it can provide the higher performance, and furthermore the present invention proposes the mixer that is capable of changing or adjusting the shearing stress applied to the fluid being processed and changing or adjusting the flow rate at which the fluid being processed is allowed to flow in accordance with the changed or adjusted shearing stress.

As another of the advantages, it may be understood that the present invention allows the higher performance rotor/stator type mixer to be designed by taking advantage of the comprehensive performance estimation method that may be applied to all of the mixers of the various forms and operating on any appropriate circulation mode as well as the design method that takes into consideration the mixer's particular running conditions (such as the processing time).

As still another of the advantages, it may be understood that the present invention allows the foods, pharmaceutical medicines, chemical products and the like to be manufactured by using the higher performance rotor/stator type mixer that can be realized by utilizing the comprehensive performance estimation method as well as the design method.

In accordance with the present invention, the index called as the total energy dissipation rate: $\epsilon_a$ is employed. The total energy dissipation rate: $\epsilon_a$ for each of the mixers having the various forms and operating on any appropriate circulation mode as offered from each of the manufacturing companies may be computed individually from the measured values for the geometrical sizes of the rotor and stator, the running powers and the fluid flow rates. This total energy dissipation rate: $\epsilon_a$ may be represented by the two terms, such as the form dependent term and the running condition dependent term for each of the mixers.

For example, when the performance for each mixer is estimated by using the index called as the total energy dissipation rate: $\epsilon_a$, the values (greater or smaller) obtained from the form dependent term may be used to estimate the mixer's performance by determining the particle size trend for the liquid drop diameters.

In order that each mixer can be scaled up or scaled down, the mixer can be designed by using the measured values obtained from the form dependent term and the running condition dependent term that are contained as components of the total energy dissipation rate: $\epsilon_a$ so that the two or more different measured values can accord with each other.

Based on the above discovery, it has now become possible to design (develop) the mixer (the higher performance mixer) that provides the higher particle size breakup effect and emulsifying effect than the existing mixer of the prior art from the aspect of both the theories and the experiments based on those theories.

In accordance with the present invention, therefore, the range of the higher mixer performance may be established by using the measured values for the form dependent term (coefficient) that may be applied to the performance estimation method for each mixer. Specifically, the performance range that does not cover the performance of the existing mixers of the prior art may be established by using the measured values for the form dependent term in the index called as the total energy dissipation rate: $\epsilon_a$, or the performance range that cannot be calculated easily by using the conventional index (theory) (it would be difficult without the actually measured values) may also be established.

In addition, the present invention provides a method of manufacturing foods, pharmaceutical medicines, chemical products and the like by subjecting the fluid being processed to the emulsifying, dispersing, particle size breaking-up or mixing operations on the rotor/stator type mixer, wherein the method includes the steps of:

calculating the total energy dissipation rate: $\epsilon_a$ to estimate the mixer's particular running time and the resulting liquid drop diameters for the fluid being processed which are obtained during the mixer's particular running time and manufacturing the foods (including diary products, drinks, etc.), the pharmaceutical medicines (including non-medical drugs, etc.) or chemical products (including cosmetics, etc.) that contain the desirable resulting liquid drop diameters.

It should be appreciated that the nutritious components (which correspond to the fluid foods, babies prepared powdery milk, etc.) that are manufactured by using the method of the present invention provide the good flavor, taste, property, quality and the like, and are good from the aspect of hygiene or workability. It should also be appreciated that it is preferable that the method of the present invention should be suited to manufacture the foods or pharmaceutical medicines; it is more preferable that it should be suited to manufacture the foods; it is much more preferable that it should be suited to manufacture the nutritious components and diary products; it is most preferable that it should be suited to manufacture the nutritious components and diary products that have the highly concentrated composition.

BEST MODE OF EMBODYING THE INVENTION

Figure 1:
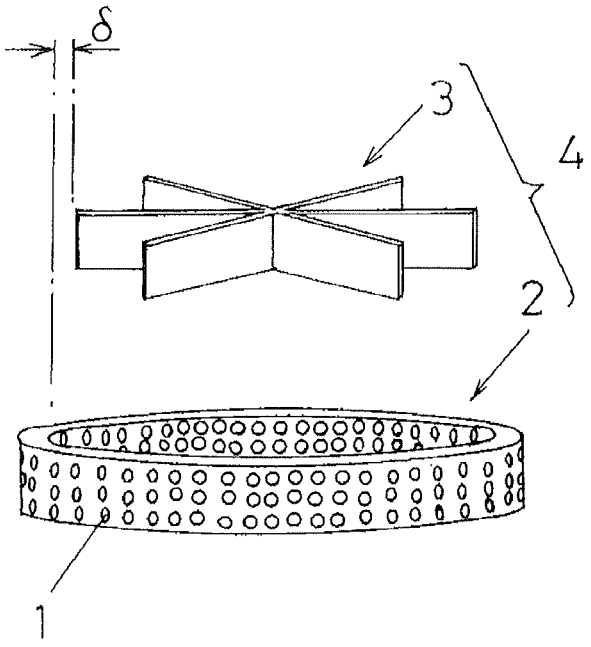
FIG. 1 is a perspective view illustrating a mixer unit included in the rotor/stator type mixer.
Figure 2:
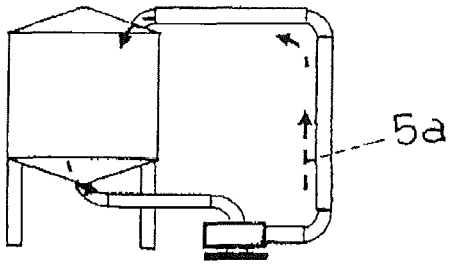
FIG. 2 illustrates the rotor/stator type mixer based on the external circulation system (the external circulation mode mixer) and the rotor/stator type mixer based on the internal circulation system (the internal circulation mode mixer)
Figure 2:
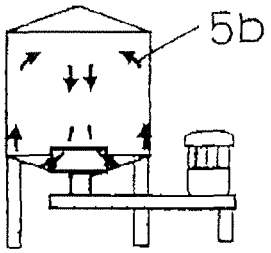

In the present invention, the index called as the total energy dissipation rate: $\epsilon_a$ that can be derived from the following Equation 1 is used to discuss (compare or estimate) the particle size breakup effect (particle size breakup trend) in the rotor/stator type mixer:

$$\begin{aligned}\varepsilon_a &= \varepsilon_g + \varepsilon_s \qquad \text{Equation 1}\\ &= [(N_p - N_{qd}\pi^2)\cdot n_r]\left\{D^3\left[\frac{\left(\frac{D^3 b}{\delta(D+\delta)}\right)+\frac{\pi^2 n_s^2 d^3(d+4\ell)}{4N_{qd}\left[\frac{n_s\cdot d^2+}{4\delta(D+\delta)}\right]}}{}\right]\right\}\left(\frac{N^4\cdot t_m}{V}\right)\\ &= [(N_p - N_{qd}\pi^2)\cdot n_r]\cdot[D^3(K_g+K_s)]\cdot\left(\frac{N^4\cdot t_m}{V}\right)\\ &= K_c\cdot\left(\frac{N^4\cdot t_m}{V}\right)\end{aligned}$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b: Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer

The use of this total energy dissipation rate: $\epsilon_a$ allows the particle size breakup effect (particle size breakup trend) for the rotor/stator type mixer to be discussed (compared or estimated) comprehensively of in the unified manner, even if there are the differences in the mixer's form, the stator's form, the mixer's particular running condition (processing time, etc.), and the mixer's scale (size, etc.).

As it may be apparent from the above description, the total energy dissipation rate: $\epsilon_a$ may be expressed in terms of the sum of the local shearing stress: $\epsilon_g$ occurring in the gap between the stator and the rotor as well as the local energy dissipation rate: $\epsilon_s$ for the stator.

In the present invention, the mixer's performance may be estimated by determining whether the values for the form dependent term:$K_c$ for all of the mixers that are unique for each of the mixers are greater or smaller, in which the values for the form dependent term:$K_c$ can be obtained by measuring the sizes of the rotor and stator, the driving power required for the mixer' running and the flow rate, all of which are components in the Equation 1 for deriving the total energy dissipation rate: $\epsilon_a$.

As it may be apparent from the Equation 1 for deriving the total energy dissipation rate: $\epsilon_a$, the values for the form dependent term:$K_g$[$m^2$] for the gap may be determined from the gap: δ [m], the rotor's diameter:D[m] and the thickness of the rotor's blade tip:b[m], and those values are unique for each of the mixers.

The values for the form dependent term:$K_s[m^2]$ for the stator may be determined from the number of flow rates:$N_{qd}$ [−], the number of openings (holes) on the stator:$n_s$[−], the stator's opening (hole) diameter:d[m], the stator's thickness: l[m], the gap between the rotor and stator: δ [m] and the rotor's diameter:D[m], and those values are also unique for each of the mixers.

The values for the form dependent term:$K_c[m^5]$ for all of the mixers may be determined from the number of driving powers:$N_p$[−], the number of flow rates:$N_{qd}$[−], the number of rotor blades:$n_r$[−], the rotor's diameter:D[m], the form dependent term:$K_g[m^2]$ for the gap and the form dependent term:$K_s[m^2]$ for the stator, and those values are also unique for each of the mixers.

It is noted that the number of driving powers:Np[−] and the number of flow rates:$N_{qd}$[−] are the non-dimensional quantity that is commonly used in the chemical engineering field. This may be defined as follows:

$Q=N_{qd}\cdot N\cdot D^3$ (Q: flow rate, N: number of rotor rotations, D: mixer' diameter)

$P=N_p\cdot\rho\cdot N^3\cdot D^5$ (ρ: density, N: number of rotor rotations, D: mixer's diameter)

Namely, the number of flow rates and the number of driving powers are the non-dimensional quantities that may be derived from the flow rates and the driving powers that are measured on the experimental basis, respectively.

Specifically, the values for the form dependent term:$K_c$ for all of the mixers are the unique values for each of the mixers that can be obtained by measuring the sizes of the rotor/stator as well as the driving powers and flow rates during the running time.

By comparing (evaluating) whether the values are greater or smaller, the performances for each of the mixers of the various types and forms can be estimated, and the higher performance mixers can also designed (developed and fabricated) accordingly.

In accordance with the present invention, the Equation 1 for deriving the total energy dissipation rate: $\epsilon_a$ that has been discussed above may be used to design those mixers (including the higher performance mixers).

<Total energy dissipation rate: $\epsilon_a$ and the changes in the resulting liquid drop diameter (particle size breakup trend for the liquid drops)>

As an object of estimating the particle size breakup, a liquid that simulates a dairy product has been prepared. This liquid that simulates the dairy product is composed of milk protein concentrates (MPC, TMP (Total Milk Protein)), rapeseed oil and water. The composition and ratio are presented in Table 1.

TABLE 1

Composition Ratio of Simulated Liquid for Milk Product

| | | |
|---|---|---|
| Composition | Milk Product Concentrate (MPC) | 8.0% |
| | Rape Seed Oil | 4.5% |
| | Water | 87.5% |
| | Total | 100% |
| Ratio | Protein/Water | 9.1% |
| | Oil/Protein | 56.3% |
| | Oil/Water | 5.1% |
| Properties | Density | 1028 kg/m$^3$ |
| | Viscosity | 15 mPa · s |

Figure 3:
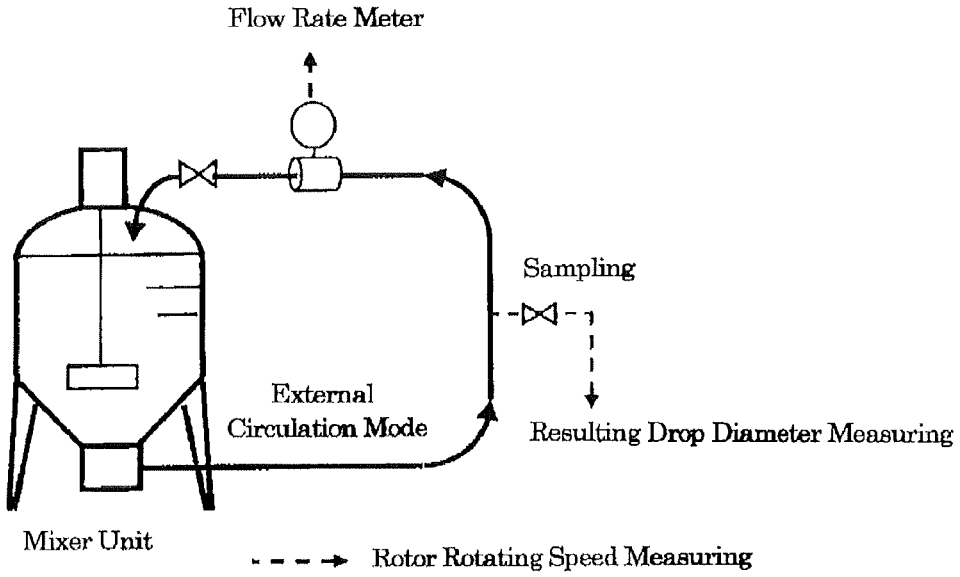
FIG. 3 is a diagram showing how the particle size breakup trend for the resulting liquid drop diameters can be investigated.
Figure 4:
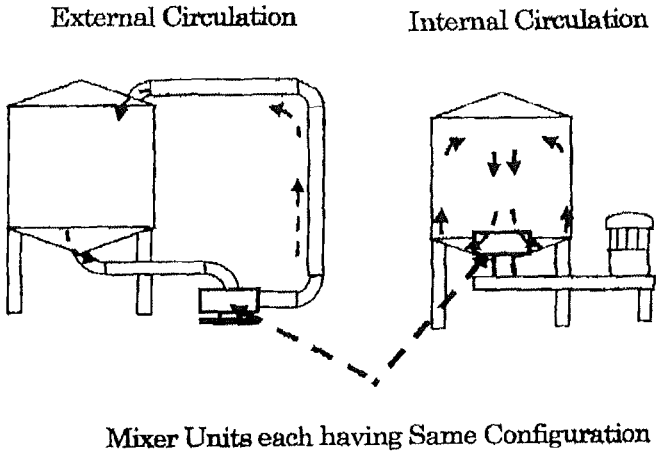
FIG. 4 is a diagram showing how the estimation testing results obtained from the external circulation mode rotor/stator type mixer (the external circulation mode mixer) can be used to estimate the internal circulation mode rotor/stator type mixer (internal circulation mode mixer)

The mixer's performance was estimated by studying the particle size breakup trend for the resulting liquid drop diameters on the experimental basis. As shown in FIG. 3, the external circulation mode unit was prepared, and the liquid drop diameters on the middle way of the fluid path was measured by using the laser diffraction type particle size analyzer (offered by Shimazu Manufacturing Company under the name of SALD-2000).

In estimating the mixer's performance by studying the particle size breakup trend for the resulting liquid drop diameters in accordance with the present invention, it has been found that that it is difficult to measure the particle size breakup trend for the resulting liquid drop diameters by using the internal circulation mode mixer. It has also been found, however, that both the external circulation mode mixer and the internal circulation mode mixer are common in that as shown in FIG. 1, each of the two different mode mixers comprises the mixer unit 4 that includes the mixer 2 having the plurality of openings 1 formed thereon and the rotor 3 disposed inwardly of the stator 2 and spaced away from the stator 2 with the specific gap δ. When the performance is to estimated for the internal circulation mode mixer, therefore, it may be assumed that the internal circulation mode mixer comprises the mixer unit that includes the rotor/stator having the same size, form and construction as the mixer unit in the external circulation mode mixer. Under this assumption, the performance for the internal circulation mode mixer was estimated by using the testing results obtained by estimating the performance for the external circulation mode mixer.

Then, the performances were estimated for the three different type mixers. The summary of each of those mixers is presented in Table 2.

TABLE 2

Summary of Mixer

| | | | Mixer A-1 1.5 L | Mixer A-2 1.5 L | Mixer B 9 L |
|---|---|---|---|---|---|
| Stator No. | | | 6 | 6 | 7 |
| Rotor Diameter | [mm] | D | 30 | 30 | 57 |
| Maximum Number of Rotations | [rpm] | $N_{max}$ | 26000 | 26000 | 8400 |
| Maximum Motor Driving Power | [kW] | $P_{g,max}$ | 0.9 | 0.9 | 1.5 |
| Number of Openings | [—] | $n_s$ | 3 | 6 | 5 |
| Size of Gap | [mm] | δ | 0.15 | 0.25 | 0.25 |
| Volume of Gap | [m$^3$] | $v_g$ | $3.56\times10^{-8}$ | $5.96\times10^{-8}$ | $2.70\times10^{-7}$ |

Number of Rotor's Blades $n_r$: 4

Each of the mixers A-1 and A-2 has a capacity of 1.5 liters and is offered from the same manufacturer except that they have the different sizes.

In Table 2, the gap volume: $v_3$ corresponds to the volume for the gap δ in FIG. 1.

The rotor 3 included in each of the mixers A-1 and A-2 (each having the capacity of 1.5 liters) and B (having the capacity of 9 liters) has the number of agitating blades which is four for the mixers A-1, A-2 and B.

The experimental conditions and the calculated values for the total energy dissipation rate: $\epsilon_a$ for those mixers are presented in Table 3.

TABLE 3

| Experimental Conditions and Calculated Values | | | | | |
|---|---|---|---|---|---|
| | Stator No. | | Mixer A-1 | Mixer A-2 | Mixer B |
| Speed of Rotation | N | [rpm] | 17000<br>13600<br>8400 | 17000<br>13600<br>8400 | 8400<br>6720 |
| Speed of Rotor's Tip | u | [m/s] | 26.8<br>21.4<br>13.2 | 26.6<br>21.3<br>13.2 | 25.1<br>20.0 |
| Ratio of Configuration Dependent Term | $Kg/(K_g+K_g)$ | [—] | 0.86<br>0.87<br>0.87 | 0.81<br>0.79<br>0.83 | 0.94<br>0.94 |
| Total Energy Dissipation Rate | $\epsilon_a$ | [$m^2/s^3$] | $14.8\times10^5$<br>$4.81\times10^5$<br>$0.92\times10^5$ | $9.03\times10^5$<br>$2.07\times10^5$<br>$0.34\times10^5$ | $7.62\times10^5$<br>$1.25\times10^5$ |

As it is shown in Table 3, $K_g/(K_g+K_s)$ has the value of above 0.5, which means that the form dependent term $K_g$ in the gap is greater than the from dependent term $K_s$ in the stator. When the particle size breakup effects in the gap δ and in the opening (hole) 1 on the stator 2 are compared for the mixers A-1 and A-2, it has been found that the particle size breakup effect in the mixer's gap δ is greater and plays a dominant part.

From the values of $\epsilon_a$ in Table 3, it was estimated that the particle size breakup effect would become higher as the gap δ in the stator was smaller or the number of rotations of he rotor 3 was greater.

Figure 5:
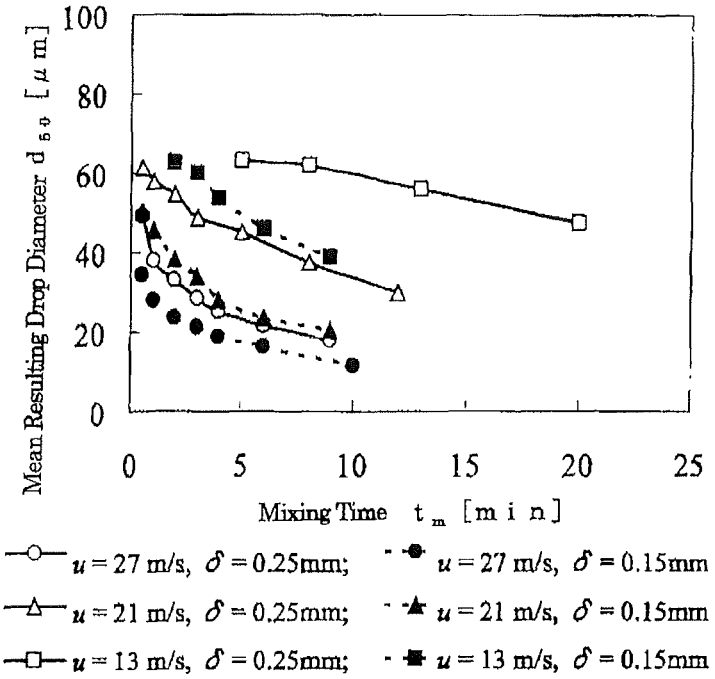
FIG. 5 represents the relationship between the processing (mixing) time and the resulting liquid drop diameters (particle size breakup trend) for the rotor/stator type mixer.

For the mixers A-1 and A-2 in Table 2, the relationship between the processing (mixing) time under the running conditions in Table 3 and the resulting liquid drop diameters (particle size breakup trend) is presented in FIG. 5.

It has been found that the resulting particle size breakup effect (particle size breakup performance) exhibits the similar trend to the estimated value of $\epsilon_a$ (theoretical value) in Table 3 and is higher when the mixer's gap δ is small for all numbers of rotations.

When the results obtained by the experiments are arranged with the processing (mixing) time being plotted along the horizontal axis, it has been found that the change in the resulting liquid drop diameters (the particle size breakup trend for the liquid drops) cannot be expressed (estimated) comprehensively or in the unified manner.

For the mixers A-1 and A-2 in Table 2, however, the relationship between the total energy dissipation rate: $\epsilon_a$ proposed by the present invention and the resulting liquid drop diameters (particle size breakup trend) is presented in FIG. 6. When the experiment results are arranged with the total energy dissipation rate: $\epsilon_a$ being plotted along the horizontal axis, therefore, it has been found that the changes in the resulting liquid drop diameters (particle size breakup trend for the liquid drops) can be expressed (estimated) comprehensively or in the unified manner.

Specifically, it has been found that the resulting liquid drop diameters will follow the similar trend of decreasing under the different running conditions (such as the difference in the number of rotations and the mixing time) and even if the mixers may have different forms (such as the differences in the size of the gap δ and the diameter of the rotor 3).

In other words, it has been confirmed that the total energy dissipation rate: $\epsilon_a$ provides the index that may be used to estimate the performance for the rotor/stator type mixer by taking account of the differences in the running condition and form.

Next, for the mixer B in Table 2, the relationship between the total energy dissipation rate: $\epsilon_a$ proposed by the present invention and the resulting liquid drop diameters (particle size breakup trend) is presented in FIG. 7. Then, it has been found that the resulting liquid drop diameters will depend upon the values for the total energy dissipation rate: $\epsilon_a$, ever if there are differences in the mixer's size.

Figure 6:
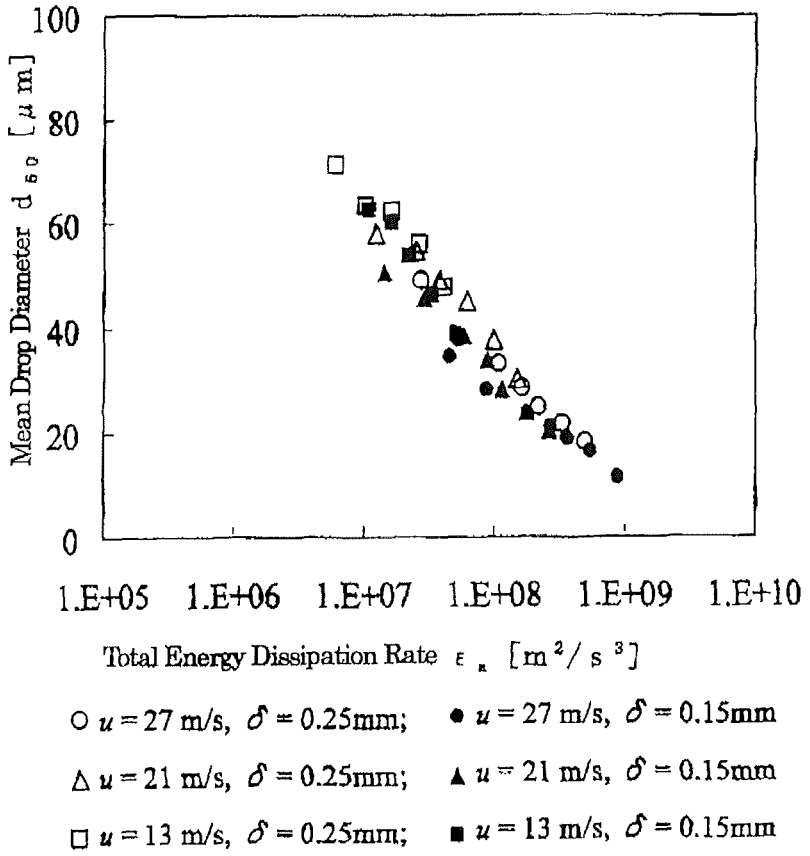
FIG. 6 represents the relationship between the total energy dissipation rate: $\epsilon_a$ and the resulting liquid drop diameters (particle size breakup trend) for the rotor/stator type mixer for which the relationship between the processing (mixing) time and the resulting liquid drop diameters (particle size breakup trend) is represented in FIG. 5.
Figure 7:
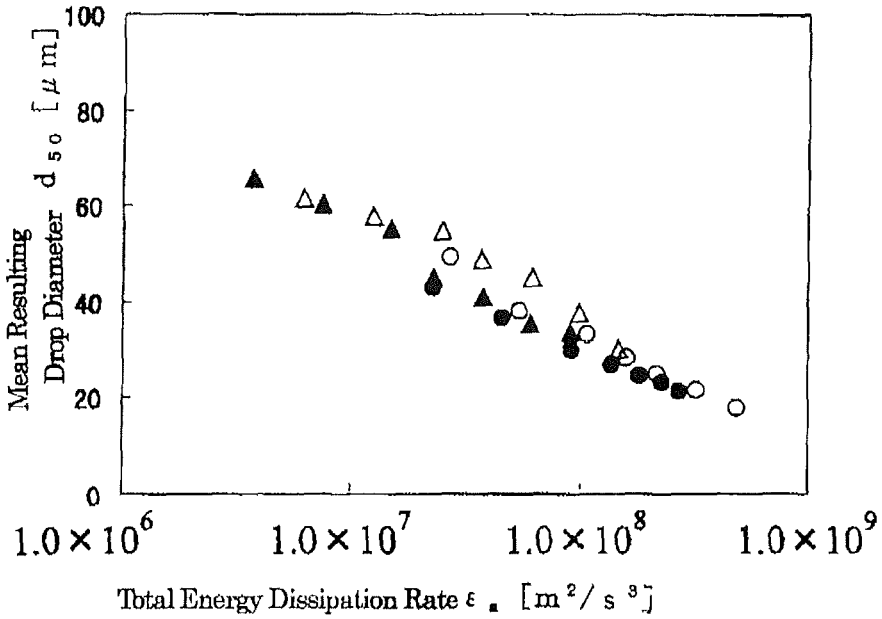
FIG. 7 represents the relationship between the total energy dissipation rate: $\epsilon_a$ and the resulting liquid drop diameters (particle size breakup trend) for the rotor/stator type mixer that has a different scale (size) from the rotor/stator type mixer for which the relationship between the processing (mixing) time and the resulting liquid drop diameters (particle size breakup trend) is represented in FIG. 6.

It may be apparent from FIG. 6 and FIG. 7 that the particle size breakup will exhibit the same trend regardless of the difference in the mixer's size.

(Estimation of the Mixer Using the Total Energy Dissipation Rate: $\epsilon_a$)

In the following description, the estimation of the rotor/stator type mixer using the Equation 1 of the present invention for deriving the total energy dissipation rate: $\epsilon_a$, that is, the estimation of such mixer using the particle size breakup effect (the particle size breakup trend) will be discussed.

In the case where there are differences in the size of the gap between the rotor and the stator, in the size of the opening (hole) (hole diameter) on the stator or in the form of the opening (hole) (the number of holes), the effect that each factor (each item) may have on the performance of the mixer's stator has been verified (estimated). The summary of the information regarding the stator that was used for this verification is presented in Table 4.

In the estimation of the performance of the actual mixer, the values of $K_c$/Kstd obtained by normalizing the form dependent term for each of the entire mixers with $K_c$ of the stator No. 3 (standard stator) were used. This means that the particle size breakup effect will become higher as the value of $K_c$/Kstd is increased.

TABLE 4

| Summary of Stator | | | |
|---|---|---|---|
| No. | Diameter of Opening [mm] | Ratio of Opening [%] | Gap [mm] |
| 1 | 1.5 | 24 | 1 |
| 2 | 2 | | |
| 3 | 4 | | |
| 4 | 6 | | |
| 5 | 4 | 12 | 1 |
| 6 | | 35 | |
| 7 | 4 | 24 | 0.5 |
| 8 | | | 2 |

Diameter of Rotor: 198 mm
Number of Rotor's Blades: 6

(Effect of the Gap Between Rotor and Stator)

Figure 8:
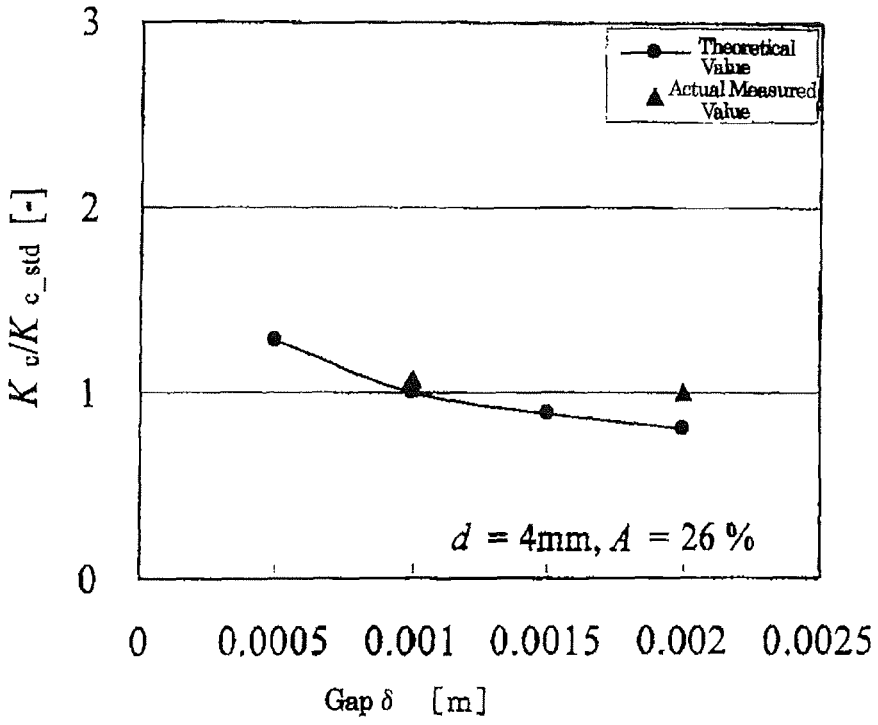
FIG. 8 illustrates how the gap between the rotor and the stator will have an effect on the resulting liquid drop diameters.

The results obtained by verifying the effect of the gap between the rotor and the stator is presented in FIG. 8.

Based on the Equation 1 of the present invention for deriving the total energy dissipation rate: $\epsilon_a$, the particle size breakup effect (particle size breakup trend) for the mixer was calculated. From this calculation, it was estimated that the value of $K_c$/Kstd (theoretical value) would become greater as the gap between the rotor and the stator was smaller.

Based on the results obtained by the actual experiments, on the other hand, the particle size breakup effect for the mixer was calculated. From this calculation, it has been found that the value of $K_c$/Kstd (actual measured value) would be increasing as the gap becomes smaller.

That the gap between the rotor and the stator is related to the resulting liquid drop diameters has been confirmed by the fact that the trend is the same both for the actual measured value and for the theoretical value. And it has been proved both theoretically and experimentally that the mixer's performance would become higher as the gap becomes smaller.

(Effect of Stator's Opening (Hole) Diameter)

Figure 9:
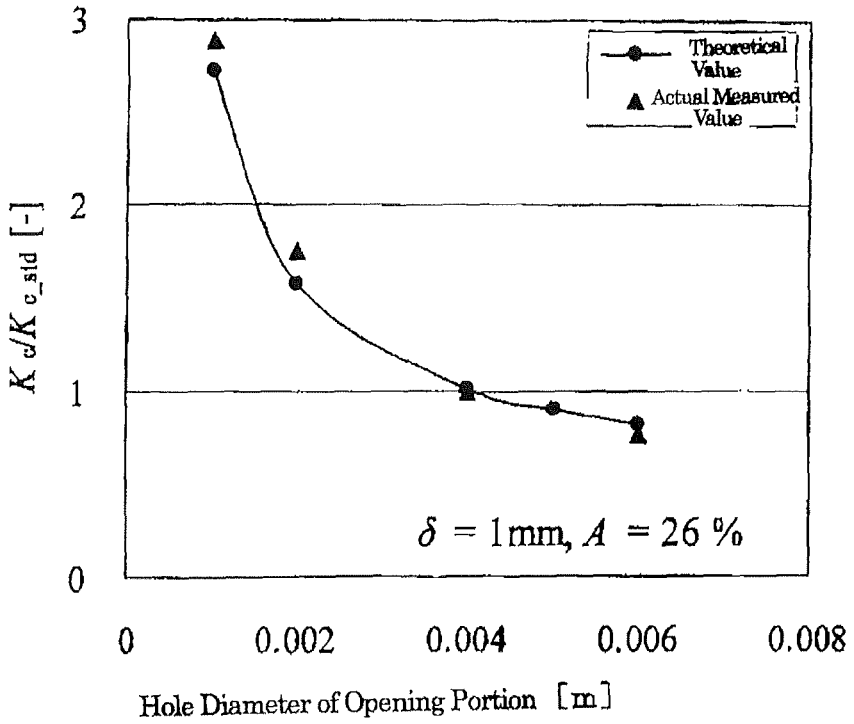
FIG. 9 illustrates how the diameter of the opening (hole) formed on the stator will have an effect on the resulting liquid drop diameters.

The results obtained by verifying the effect of the stator's opening (hole) diameter is presented in FIG. 9.

Based on the Equation 1 of the present invention for deriving the total energy dissipation rate: $\epsilon_a$, the particle size breakup effect (particle size breakup trend) for the mixer was calculated. From this calculation, it has been estimated that the value of $K_c$/Kstd (theoretical value) would become greater as the stator's opening (hole) diameter becomes smaller.

Based on the results obtained by the actual experiments, on the other hand, the particle size breakup effect for the mixer was calculated. From this calculation, it has been found that the value of $K_c$/Kstd (theoretical value) would become greater as the stator's opening (hole) diameter becomes smaller.

The fact that the stator's opening (hole) diameter is related to the particle size breakup effect has been confirmed by the fact that the trend is the same both for the actual measured value and for the theoretical value. And it has been proved both theoretically and experimentally that the mixer's performance would become higher as the stator's opening (hole) diameter becomes smaller.

It should be noted that the effect of the stator' opening (hole) diameter is greater than the effect of the gap between the rotor and the stator.

(Effect of the Number of Stator's Opening (Hole) (Opening-to-Area Ratio)

Figure 10:
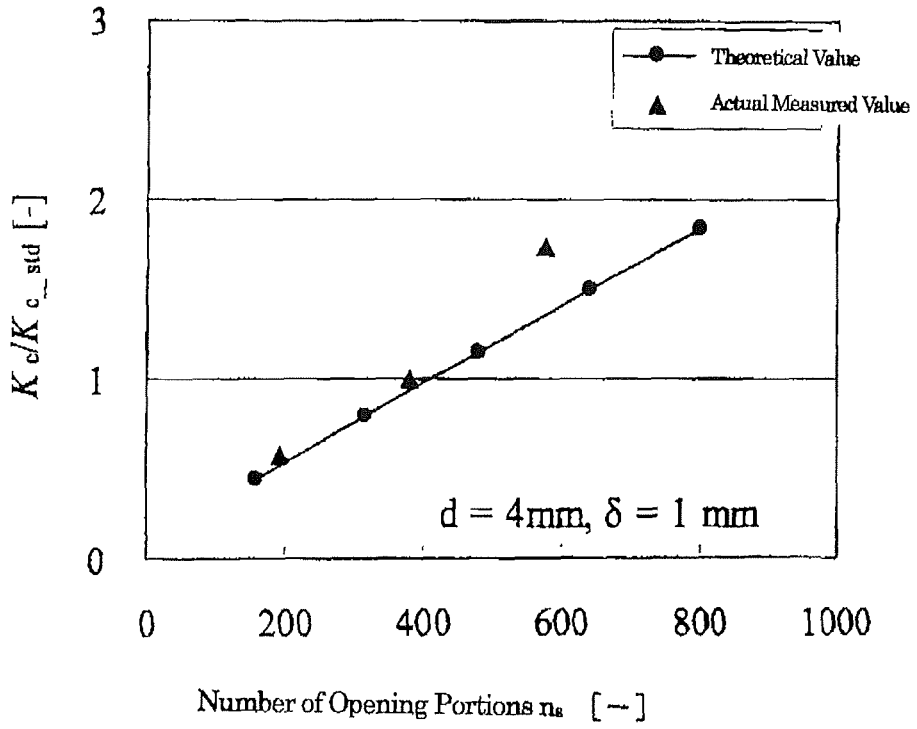
FIG. 10 illustrates how the number (opening-to-area ratio) of the openings (holes) formed on the stator will have an effect on the resulting liquid drop diameters.

The results obtained by verifying the effect of the number of the stator's opening (hole) are presented in FIG. 10.

Based on the Equation 1 of the present invention for deriving the total energy dissipation rate: $\epsilon_a$, the particle size breakup effect (particle size breakup trend) for the mixer was calculated. From this calculation, it has been estimated that the value of $K_c$/Kstd (theoretical value) would become greater as the number of openings (holes) on the stator is greater.

Based on the results obtained by the actual experiments, on the other hand, the particle size breakup effect for the mixer was calculated. From this calculation, it has been found that the value of $K_c$/Kstd (actual measured value) would become greater as the number of openings (holes) on the stator is greater.

The fact that the number of openings (holes) for the stator is related to the particle size breakup effect has been confirmed by the fact that the trend is the same both for the actual measured value and for the theoretical value. And it has been proved both theoretically and experimentally that the mixer's performance would become higher as the number of openings (holes) on the stator becomes greater.

It should be noted that the effect of the number of openings (holes) on the stator is greater than the effect of the gap between the rotor and the stator.

(Performance Improvement Effect for the Existing (Commercial) Mixer)

Figure 11:
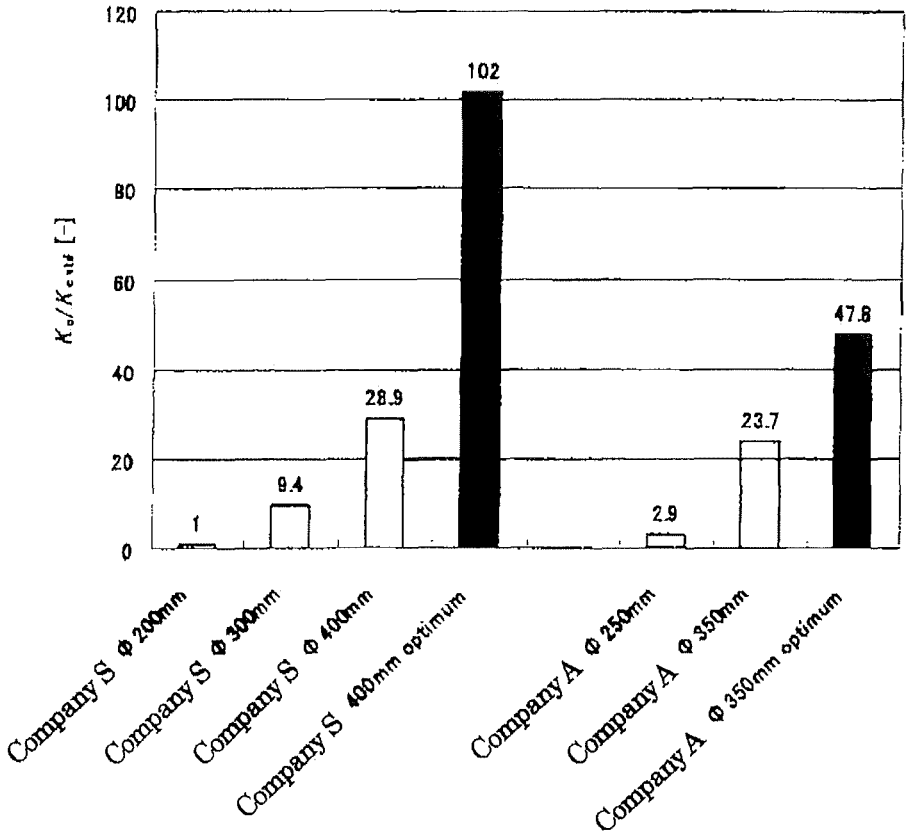
FIG. 11 illustrates how the performance improvement could be attained by the existing mixer of the prior art.

Based on the Equation 1 of the present invention for deriving the total energy dissipation rate: $\epsilon_a$, the performances of the mixers that have been offered by the S company and the A company were compared. The results obtained by this comparison are presented in FIG. 11. Based on the mixer's design method (concept idea) of the present invention, the forms for both mixers have been changed and then how the respective performances for those mixers would be improved by this change has been estimated. The results obtained by this estimation are also presented in FIG. 11. From those results, it has been found that although the mixers from the S company and the A company include the different diameter rotor or stator, respectively, the same index may be used to estimate the respective performances for those different mixers.

For the mixers from the S company (having the rotor diameter D of 400 mm), for example, the gap δ between the rotor and the stator can be decreased from 2 mm to 0.5 mm. The number of the stator's openings (opening-to-area ratio) $n_s$ can be increased from 12% to 40%. It can be thought, therefore, that by decreasing the stator's opening diameter d from 4 mm to 3 mm, the particle size breakup effect or emulsification effect (performance) may be improved by a factor of about 3.5. This means that the current processing (running) time can be reduced considerably, that is, by the order of 30%.

For the mixers from the A company (having the rotor diameter D of 350 mm), on the other hand, the gap δ between the rotor and the stator can be decreased from 0.7 mm to 0.5 mm. The number of the stator's openings (opening-to-area ratio) $n_s$ can be increased from 25% to 40%. It can be thought, therefore, that by decreasing the stator's opening diameter d from 4 mm to 3 mm, the particle size breakup effect or emulsification effect (performance) may be improved by a factor of about 2.0. This means that the current processing (running) time can be reduced considerably, that is, by the order of 50%.

(Form and Design of High Performance Mixer)

The high performance mixer proposed by the present invention is constructed such that the rotor that is disposed inwardly of the stator and spaced away from the stator with a specific gap has the rotor peripheral wall that is located inwardly radially of the stator peripheral wall so that it can face opposite the inside of the stator peripheral wall in which the rotor peripheral wall has a plurality of openings (holes) formed thereon. By this construction, the shearing stress applied to the fluid being processed can be improved so that the high performance can achieved.

In the high performance mixer thus constructed, a multistage (two or more stages) mixing section that is composed of a mixing portion located inwardly radially and a mixing portion located outwardly radially will be formed when the rotor is rotated. This multistage mixing section thus formed can improve the shearing stress applied to the fluid being processed, thereby achieving the high performance.

In the high performance mixer proposed by the present invention, furthermore, the stator and the rotor can be moving closer to or farther away from each other in the direction in which the rotary shaft of the rotor extends so that the gap or spacing between the rotor and the stator can be adjusted or changed while the rotor is being rotated. Thus, the shearing stress applied to the fluid being processed can also be changed or adjusted or the rate flow at which the fluid being processed flows can also be changed or adjusted.

In the high performance mixer proposed by the present invention, a mechanism is provided for injecting (adding) the fluid being processed directly into the mixing section. This mechanism coupled with the multistage mixing section described above can achieve the higher performance.

The form and construction of the high performance mixer proposed by the present invention are defined by using, as the reference information, the performance estimation based on the values of the total energy dissipation rate: $\epsilon_a$ that can be derived from the Equation 1 of the present invention as well as the results obtained by verifying those values. The design of the high performance mixer is based on the above definition, and the summary of the information of the mixers is presented in FIGS. 12 to 18.

(Moving Stator)

When the rotor/stator type mixer is used to dissolve (prepare) a powdery material or liquid material into a prepared liquid, thereby manufacturing an emulsified product, any gaseous substance (such as air) that has been brought together with the powdery material would cause fine air bubbles to be produced. If those fine air bubbles thus produced are not removed from the prepared liquid by any appropriate means, they would be mixed into the prepared liquid when the prepared liquid is processed by the mixer. It has been known that if the prepared liquid that still contains those fine air bubbles is to be emulsified, the particle size breakup or emulsifying performance (effect) that results from this emulsification process would become worse than if the fine air bubbles are removed from the prepared liquid.

From the above aspect, therefore, it is desirable that the mixer should include the mechanism that allows the stator to be moving in order to prevent the fine air bubbles from being produced at the initial stage of dissolving the powdery material. Particularly, when the emulsified product that is easy to produce fine air bubbles is to be processed, it is desirable that the mixer should include such mechanism. At the initial stage of dissolving the powdery material, the stator may be moving away from the rotor so that the powdery material can be diffused quickly into the prepared liquid without causing the high energy to be dissipated. Then, the stator may be brought closer to the rotor. Indeed, this will provide the better procedure for dissolving, particle size breaking up and emulsifying.

(Multistage Homogenizer)

As described above, it has been confirmed that the particle size breakup or emulsification performance (effect) would become better as the total energy dissipation rate: $\epsilon_a$ for deriving the Equation 1 of the present invention becomes greater.

Here, the value for the total energy dissipation rate: $\epsilon_a$ may be defined in terms of the product of the local energy dissipation rate: $\epsilon_L$ and the shearing frequency: $f_{s,h}$. In order to increase the shearing frequency:$f_{s,h}$, it can be thought that it would be more effective that the multistage stator should be provided in the particle size breakup or emulsification process. In other words, the effective way would be that the mixer should have the two or more stage configuration so that the high performance can be achieved.

Here, the local energy dissipation rate: $\epsilon_L$ and the shearing frequency: $f_{s,h}$ may be defined as follows:

Local energy dissipation rate: $\epsilon_L$ [$m^2$ $s^3$]=$F_a U/\rho v_s$

Fa: Average driving power [N]

U: Blade forward end speed [m/s]

ρ: Density [$k_g/m^2$]

Average driving power: $F_a$ [N]=$\tau_a$ $S_s$ $\tau_a$: Average shearing power $S_s$: Shearing area [$m^2$]

Average shearing driving power: $\tau_a=P_h/Q$ $P_h$: Emulsify contributory power [kW]

Q: Flow rate [$m^3$/h]

Emulsify driving power dissipation: $P_h$]kW]=$P_n-P_p$

Pn: Net driving power [kW]

$P_p$: Pump driving power [kW]

Shearing frequency: $f_{s,h}$ [1/s]=$n_s$ $n_r$ N/$n_v$ $n_s$: Number of stator's holes [No]

$n_r$: Number of rotor blades [No]

N: Number of rotations [l/s]

$n_v$: Stator's hole volume [$m^3$]

Shearing area: $S_s$[$m^2$]=$S_d+S_L$ $S_d$: Hole sectional. area $S_L$: Hole area Hole Sectional. Area: $S_d$ [$M^2$]=π/4 $d^2$ d: Stator's hole diameter [in]

Hole area: $S_L$[$m^2$]=πd L

L: Stator's thickness [in]

(Direct Injection)

From the mixer's performance estimation based on the index that is the total energy dissipation rate: $\epsilon_a$ derived from the Equation 1 of the present invention as well as the results obtained by this estimation, it has been found that the particle size breakup and emulsifying performance (effect) will be affected mainly by the diameter and number of openings (holes) on the stator (opening-to-area ratio).

Then, the emulsification and diffusion can be accomplished more effectively by feeding any oils, insoluble component or trace components directly into the mixing section provided in the mixer. Particularly, the oils or the like may be fed directly into the first stage stator (stator located inwardly radially) where the preliminary emulsification may take place), and then may be fed into the second stage stator (stator located outwardly radially) where the final emulsification followed by the diffusion may take place.

(Form of High Performance Mixer)

From the mixer's performance estimation based on the index that is the total energy dissipation rate: $\epsilon_a$ derived from the Equation 1 of the present invention as well as the results obtained by this estimation, it has been found that the mixer's performance will become higher when the diameter of the opening (hole) on the stator is as small as possible, the number of the openings is as small as possible, and the gap between the rotor and the stator is as small as possible. In addition, it has been found that the shearing frequency will become higher as the number of rotor's blades is greater.

As described above, the particle size breakup or emulsification performance (effect) will become better as the gap between the rotor and the stator is smaller. During the current verification experiment process, however, it has been found that the gap will not affect the particle size breakup or emulsification performance (effect) more than the diameter or number of openings.

Rather, it has also been found that the gap which is smaller may produce the risk that the rotor and the stator may engage each other. For the mixer that includes the mechanism for allowing the stator to be moving, the stator can be made to move closer to the rotor along the direction in which the rotor's rotary shaft extends while the mixer is running. It is sufficient, therefore, that the clearance is equal to the order of 0.5 to 1 mm. From the aspect of avoiding the risk that the rotor and the stator might engage each other, the clearance should not be less than 0.5 mm.

In the current experiment to verify the above fact, it has been found that there will be a risk that the powdery material might clog the gap if the stator's opening has the diameter of less than 2 mm. In order that the powdery material can be dissolved and emulsified at the same time, therefore, the stator' opening should have the diameter of 2 to 4 mm.

Although the shearing frequency will become higher as the number of openings (opening-to-area ratio) on the stator becomes greater, on the other hand, this may raise the problem regarding the strength of the stator's opening. In many cases, it is general that the opening-to-area ratio of 18% to 36% is adopted in the prior art. In the current experiment to verify the above fact, it has been found that it is preferable that the opening-to-area ratio should be equal to above 15%, it is more preferable that it should be equal to above 20%, it is much more preferable that it should be equal to above 30%, it is preferable that it is most preferable that it should be equal to above 40%, and it is the most preferable that it should be equal to 40% to 50%.

(The Best Form of Stator' Opening when Openings are Compared for the Same Opening Diameter and the Same Opening-to-Area Ratio)

It is better that the form of the stator's opening (hole) should have the round-like shape, not the comb-like shape. It is known that the local energy dissipation rate: $\epsilon_L$ is proportional to the shearing area: $S_s$. It follows from this that the shearing area: $S_s$, which is round, will become maximal if its sectional area is the same. It can be thought, therefore, that the particle size breakup or emulsification performance (effect) is better for the round shape than for the comb shape.

Table 5 presents the results obtained by calculating the total energy dissipation rate: $\epsilon_a$ when only the shape of the opening formed on the stator is changed (such as the round, square or rectangular shape) while the other conditions remain to be unchanged.

TABLE 5

Comparison of Configurations of Opening for Stator

| | | | Round Cross Section | Square Cross Section | Rectangular Cross Section (Aspect Ratio 2) | Rectangular Cross Section (Aspect Ratio 3) | |
|---|---|---|---|---|---|---|---|
| Length of Diameter or One Side | d | [m] | | | 0.004 | | |
| Thickness of Statc | l | [m] | | | 0.0025 | | |
| Height of Stator | h | [m] | | | 0.032 | | |
| Inner Diameter of Stator | D | [m] | | | 0.2 | | |
| Ratio of Opening | a | [—] | | | 0.24 | | |
| Area of Opening | S | [$m^2$] | | | 2.01E−02 | | |
| Cross Sectional Area per One Hole | $S_d$ | [$m^2$] | 1.26E−05 | 1.60E−05 | 3.20E−05 | 4.80E−05 | |
| Number of Holes | $n_s$ | [—] | 1600 | 1257 | 628 | 419 | |
| Shear Cross Sectional Area | $S_s$ | [$m^2$] | 4.40E−05 | 5.60E−05 | 9.20E−05 | 1.28E−04 | |
| Configuration Factor | K | [$m^2$] | 0.070 | 0.070 | 0.058 | 0.054 | $S_s \times n_s$ |
| Ratio | α | [—] | 1.000 | 1.000 | 0.821 | 0.762 | |
| | | | Reference | Equal | Smaller | Smaller | |

Specifically, the number of openings (holes) will become greater for the round and square shapes than for the comb (rectangular section) shape, and the shearing aria will be increased accordingly. From this, it follows that the total energy dissipation rate: $\epsilon_a$ will also become higher, which means that the mixer's particle size breakup and emulsification performance will be improved when the opening has the round or square shape.

From the comparison of the factors for the different forms in Table 5, it can be thought that the performance is equivalent for the square and round shapes. Because the square shape needs more labor when it is worked, however, the round cross-section is considered to be the best from the aspects of the particle size breakup or emulsification performance provided by the mixer and from the aspect of the workability of the shape.

(Number of Rotor's Agitating Blades)

From the standpoint of the higher shearing frequency, it will be better that the number of rotor's agitating blades should be great. If the outlet flow rate is reduced, however, there are some cases in which the particle size breakup or emulsification performance (effect) may be decreased because the frequency with which the fluid will circulate within the tank is decreased. The theoretical equation as defined above shows that the total energy dissipation rate: $\epsilon_a$ will become higher as the number of rotor's agitating blades is greater. Generally, the number of rotor's agitating blades is six, but if the number is simply eight (8), it will provide the particle size breakup or emulsification performance (effect) that is enhanced by the factor of 1.3.

(Mixer's Scale-up)

Through the experiments conducted for the verification purposes and by applying the index (theory) proposed by the present invention, it has been found that the mixer's scale-up method can be utilized as a useful tool. In particular, this scale-up method provides the useful tool when the processing (manufacturing) time is considered.

(Comparison Between Existing Mixer and Novel Mixer)

The results obtained by comparing the typical existing mixer and the novel mixer proposed by the present invention in reference to the respective features are presented in Table 6.

TABLE 6

Comparison between Existing Mixer and Inventive Mixer

| | | | | | Company D | | |
|---|---|---|---|---|---|---|---|
| | Inventive Mixer | Company A | Company B | Company C | D-1type | D-2type | Company E |
| Moving Stator | ○ | ○ | X | X | ○ | X | X |
| Multistage | ○ | X | ○ | X | X | ○ | ○ |
| Direct Injectio | ○ | X | ○ | X | X | X | X |
| Gap | 0.5~1 mm | 1~2 mm | 0.3~0.8 mm | 0.7 mm | 0.5~1 mm | 0.5~1 mm | 0.25~1 mm |
| Configuration of Stator | Round | Round Slit | Slit | Round Slit | Slit | Slit | Slit |
| Ratio of Opening | 40% | 12~36% | Saw Teeth | 25% | Saw Teeth | Saw Teeth | Saw Teeth |
| Number of Rotor's Blades | 8 | 6 | Saw Teeth | 6 | Saw Teeth | Saw Teeth | Saw Teeth |

At present, there are no such mixers as those which include the features of "Moving Stator", "Multistage Homogenizer" and "Direct Injection" that have been proposed by the present invention. It is believed that the mixers that have the best stator configuration (gap, hole diameter, opening-to-area ratio, hole shape) and the best rotor configuration (number of blades and blade width) which have been set as determined by values of $\epsilon_a$ proposed by the present invention provide the much higher emulsification and particle size breakup performances (effects).

The relationship between the total energy dissipation rate: $\epsilon_a$ that may be obtained by the Equation 1 of the present invention as described above and the particle size breakup trend for the resulting liquid drop diameters has been examined for the three different mixers under the following conditions.

In this examination, the mixer D (the capacity of 100 liters), the mixer D (the capacity of 500 liters) and the mixer E (the capacity of 10 kilo liters) have been used, the summary of which is presented in Table 7. Those three different mixers are offered by the same manufacturer, and are commercially available. In this examination, the mixer C includes five different type mixers (Stator No. 1 to 5), each having a different gap δ and a different number of openings 1 formed thereon.

TABLE 7

Summary of Mixers

| | | | Mixer C 100 L | | | | | Mixer D 500 L | Mixer E 10 kL |
|---|---|---|---|---|---|---|---|---|---|
| | | | Stator No. | | | | | | |
| | | | 1 | 2 | 3 | 4 | 5 | 6 | 7 |
| Rotor's Diameter | [mm] | D | 198 | 198 | 198 | 198 | 198 | 198 | 396 |
| Stator's Opening Diameter | [mm] | d | 4 | 4 | 4 | 4 | 1 | 4 | 4 |
| Ratio of Opening | [—] | A | 0.11 | 0.20 | 0.31 | 0.26 | 0.12 | 0.26 | 0.18 |
| Number of Openings | [—] | $n_s$ | 173 | 316 | 500 | 411 | 3090 | 414 | 1020 |
| Size of Gap | [mm] | δ | 2 | 2 | 2 | 1 | 1 | 1 | 2 |

Number of Rotor Blades $n_r$: 6

In Table 7, the opening-to-area ratio A is a non-dimensional quantity that may be computed in terms of "all opening aria (=one opening area×number)/stator's surface area"

The experiment conditions and the values obtained by calculating the total energy dissipation rate: $\epsilon_a$ are presented in Table 8.

TABLE 8

Experimental Conditions and Calculated Values

| | | | Stator No. (Mixer C) | | | | |
|---|---|---|---|---|---|---|---|
| | | | 1 | 2 | 3 | 4 | 5 |
| Configuration Dependent Term | $K_c$ | [$m^5$] | $3.52 \times 10^{-3}$ | $8.51 \times 10^{-3}$ | $1.43 \times 10^{-3}$ | $1.54 \times 10^{-2}$ | $3.14 \times 10^{-2}$ |
| Ratio of Configuration Dependent Term | $K_c/K_{c_}$std | [—] | 0.23 | 0.55 | 0.93 | 1.00 | 2.04 |
| Total Energy Dissipation Rate | $\epsilon_a$ | [$m^2/s^3$] | $6.67 \times 10^3$ | $19.8 \times 10^3$ | $33.1 \times 10^3$ | $35.6 \times 10^3$ | $73.0 \times 10^3$ |

N = 1317 [rpm],
V = 0.1 [$m^3$]

In this examination, the conditions are given as follows. The gap δ between the rotor 3 and the stator 2 is great (such as δ>8 mm, e.g. δ=2 to 10 mm), and the stator 2 has a great number of openingsl (holes) 1 formed thereon (such as $n_s$>20, E.G. $n_2$=50 to 5000). Under the above conditions, the performances for those three different mixers have been compared.

In the above examination, the liquid that simulates an diary product and has the composition ratio in Table 1 has been used to estimate the particle size breakup. As shown in FIG. 3, the external circulation mode unit has been provided, and the particle size breakup trend for the resulting liquid drop diameters have been investigated and estimated by measuring the resulting liquid drop diameter on the middle way of the fluid path using the laser diffraction type particle size analyzer (offered by Shimazu Manufacturing Company under the name of SALD-2000).

It is clear from Table 8 that the value of $K_g/(K_g+K_s)$ is 0.1 to 0.3, which means that the form dependent term $K_s$ for the stator is greater than the form dependent term $K_g$ for the gap. For the mixer C in Table 7, it has been found that the opening 1 on the stator 2 provides the higher and dominating particle size breakup performance when the particle size breakup effects for the gap and for the opening (hole) 1 on the stator 2 are compared.

From the value of $K_c/K_{c_sid}$ that is normalized with $K_c$ for the Stator No. 4 in Table 8, it has been estimated that the particle size breakup effect will become higher as the stator No. is increased.

Figure 12:
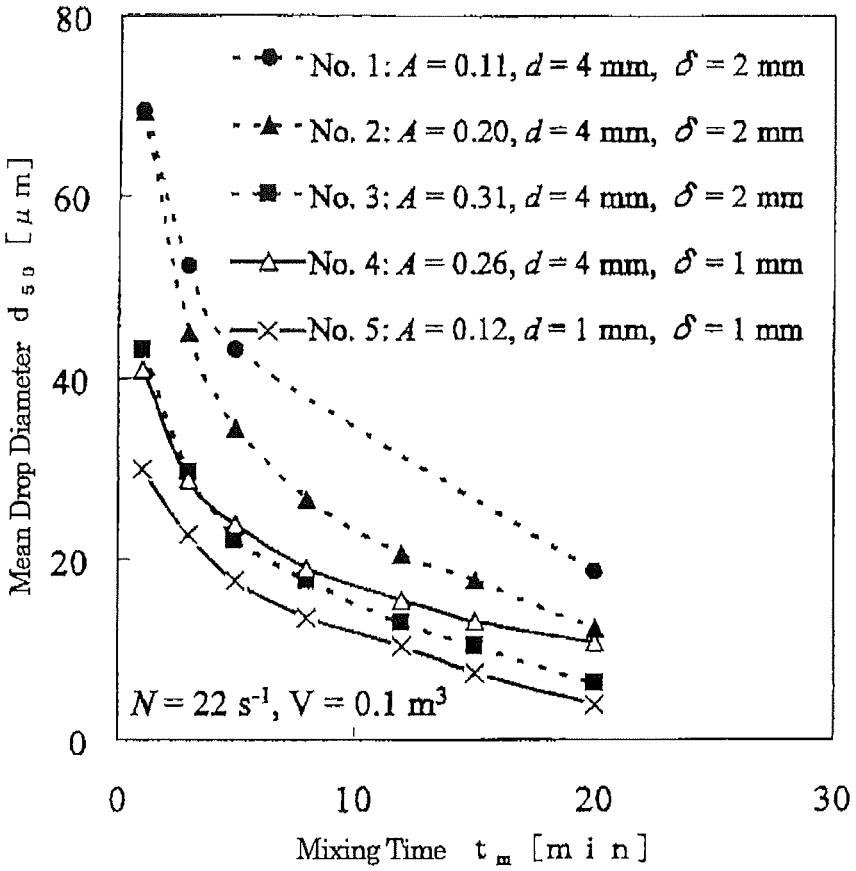
FIG. 12 represents the relationship the running (mixing) time and the resulting liquid drop diameters (particle size breakup trend) under the running conditions presented in Table 5 for the small size mixer.

For the mixer C (stator No. 1 to stator No. 5), the relationship between the processing (mixing) time under the running condition in Table 8 and the resulting liquid drop diameters (particle size breakup trend) is presented in FIG. 12.

It has been found that the trend is similar to the trend indicated by the estimated values (theoretical values) of $K_c/K_{c_sid}$, and that for any of the stator Nos. 1 to 5, the particle size breakup effect (performance) will be high when the values of $K_c/K_{c\ c_sid}$ are great. When the processing (mixing) time under the running condition is considered to be adequate, on the other hand, it has been found that it is preferable that the opening-to-area ratio should be equal to above 0.15 (15%), it is more preferable that it should be equal to above 0.2 (20%), it is much more preferable that it should be equal to above 0.3 (30%), it is most preferable that it should be equal to above 0.4 (40%), and it is the most preferable that it should be equal to 0.4 to 0.5 (40% to 50%). This should be made by taking account of the strength of the stator's opening.

For the stators No. 3 and No. 4 for which the respective values of $K_c/K_{c\ c_sid}$ are equivalent, the respective particle size breakup trends are substantially the same. By determining the mixer's performance from the total energy dissipation rate: $\epsilon_a$ that can be obtained by the Equation 1 of the present invention, therefore, it has been found that the trend can be described (estimated) not only qualitatively but also quantitatively.

When the experiment results are arranged with the running time being plotted along the horizontal axis, it has been found that the changes in the liquid drop diameters (the particle size breakup trend for the liquid drop diameters) cannot be represented (estimated) collectively.

Next, for the mixer C (stator No. 1 to stator No. 5) in Table 7, the relationship between the total energy dissipation rate: $\epsilon_a$ that can be obtained by the Equation 1 of the present invention and the resulting liquid drop diameters (particle size breakup trend) is presented in FIG. 13.

When the experiment results are arranged with the total energy dissipation rate: $\epsilon_a$ that can be obtained by the Equation 1 of the present invention being plotted along the horizontal axis, it has been found that the changes in the liquid drop diameters (the particle size breakup trend for the liquid drop diameters can be represented (estimated) collectively. More specifically, it has been found that the liquid drop diameters will follow the trend of decreasing in the same way, even if there are differences in the running condition (such as the number of rotations and the mixing time) and the mixer's configuration (such as the gap, the stator's opening diameter and the stator's opening-to-area ratio).

In other words, it has been confirmed that the total energy dissipation rate: $\epsilon_a$ that can be obtained by the Equation 1 of the present invention for the rotor/stator type mixer provides the index that allows the mixer's performance to be estimated by considering the differences in the running condition and configuration comprehensively.

Next, for the mixers D and E in Table 7, the relationship between the total energy dissipation rate: $\epsilon_a$ that can be obtained by the Equation 1 of the present invention and the resulting liquid drop diameters (particle size breakup trend) is presented in FIG. 14. Even if there are differences in the mixer's scale (size) such as the capacities of 200 to 700 liters, it has been found that the liquid drop diameters will depend on the magnitude of the values (greater or smaller) of $\epsilon_a$. Similarly, it has been found that the liquid drop diameters will exhibit the similar particle size breakup trend even it there are differences in the mixer's scale (size).

From the above description, therefore, it is believed that the rotor/stator type mixer for which the gap δ between the rotor 3 and the stator 2 is great (such as δ>1 mm, e.g. δ=2 to 10 mm) and the number of stator's openings (holes) 1 is great (such as $n_s$>20, e.g. $n_s$>50 to 5000) can be scaled up by causing the different values of the total energy dissipation rate: $\epsilon_a$ that are obtained by the Equation 1 of the present invention to accord with each other and then by considering the differences in the running condition and configuration.

Figure 13:
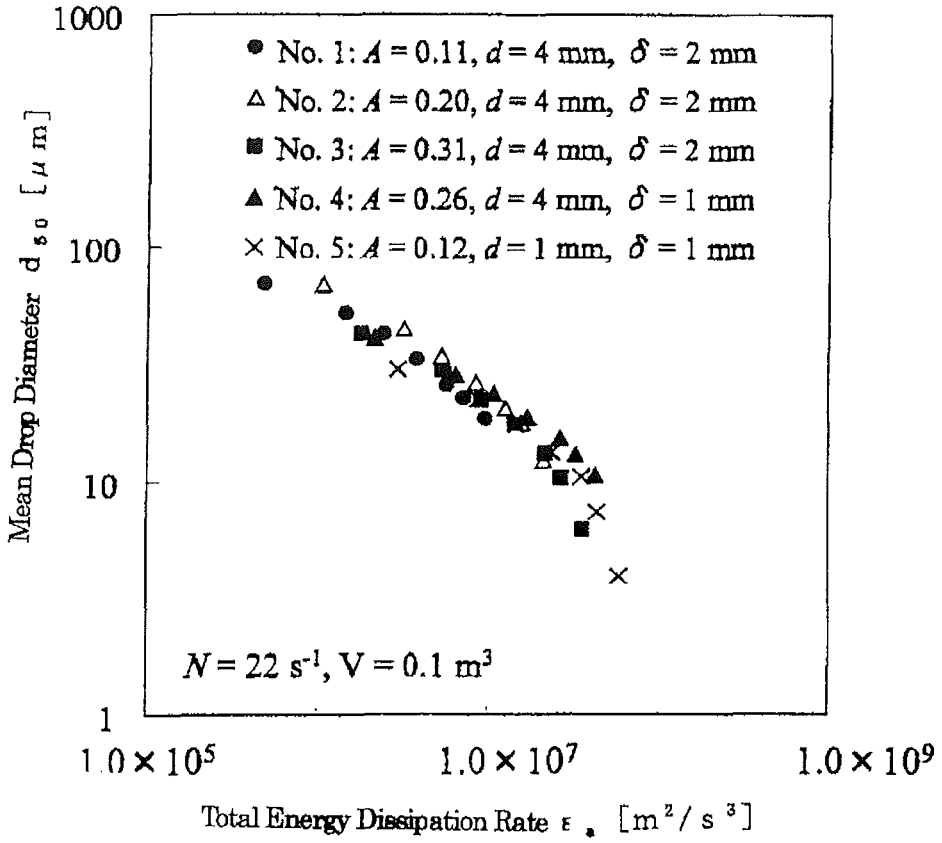
FIG. 13 represents the relationship between the total energy dissipation rate: $\epsilon_a$ and the resulting liquid drop diameters (particle size breakup trend) under the running condition presented in Table 5 for one large size mixer.

In this way, it may be seen form FIG. 13 that for the relationship between the total energy dissipation rate: $\epsilon_a$ that is obtained by the Equation 1 of the present invention and the resulting liquid drop diameters (particle size breakup trend), the changes in the liquid drop diameters (particle size breakup trend for the liquid drops) can be represented (estimated) comprehensively by plotting the total energy dissipation rate: $\epsilon_a$ that is obtained by the Equation 1 of the present invention along the horizontal axis.

Through the study conducted by the inventors, it has been recognized that the relationship between the total energy dissipation rate: $\epsilon_a$ that is obtained by the Equation 1 of the present invention and the resulting liquid drop diameters is changing linearly.

Because it is difficult to derive any statistically reliable equation that may be used for the experiment purposes, however, the liquid drop diameters have been estimated by using the relationship between the resulting liquid drop diameters obtained from the experiment and the total energy dissipation rate: $\epsilon_a$ that can be obtained by the Equation 1 of the present invention.

It may be apparent from the foregoing description that the total energy dissipation rate: $\epsilon_a$ may be divided into the two terms, that is, the form dependent term and the manufacture condition term (including the time) other than the form dependent term. As the form dependent term becomes greater with the manufacture condition term being fixed, the total energy dissipation rate: $\epsilon_a$ will become greater, and consequently the resulting liquid drop diameters will become smaller even under the same manufacture condition (time).

More specifically, the particle size diameters may be measured actually under a given manufacture condition and then the value of $\epsilon_a$ may be calculated. The value of $\epsilon_a$ required for obtaining the particular liquid drop diameters can be found from the actual measurement.

Next, the value of $\epsilon_a$ obtained by the calculation that is made after the mixer's configuration has been changed and the value of $\epsilon_a$ obtained by the calculation that is made before that change is made have been compared and the trend in which the liquid drop diameters are decreasing after that change may be estimated from that comparison.

Although the statistically highly reliable equation that can be used for the experiment purposes is not available, the trend in which the resulting liquid drop diameters are decreasing may be estimated by utilizing the above experiment results and by considering the possible effect of the mixer's configuration.

Embodiments

Although the present invention will be described below with reference to several preferred embodiments thereof shown in the accompanying drawings, it should be understood that the present invention is not limited to those preferred embodiments but may be modified in numerous ways without departing from the spirit and scope as defined in the appended claims.

It has been described that the mixer's performance can be estimated by using, as the index, the total energy dissipation rate: $\epsilon_a$ that can be derived by the Equation 1 of the present invention and that the high performance mixer's configuration can be defined by using, as a referential information, the results obtained by verifying the above performance estimation. Now, the high performance mixer that has been designed based on the above definition will be described in further detail by referring to FIG. 15 to FIG. 17.

The rotor/stator type mixer as proposed by the present invention may be characterized by the fact that it comprises a mixer unit 14 that includes a stator having a plurality of openings formed thereon and a rotor disposed inwardly radially of the stator and spaced away from the stator with a specific gap, the other parts being similar to those of the prior art rotor/stator type mixer that has been described above by referring to FIG. 1. Thus, the following description illustrates one example of the mixer unit 14 that includes the structural features that characterize the present invention.

Figure 16:
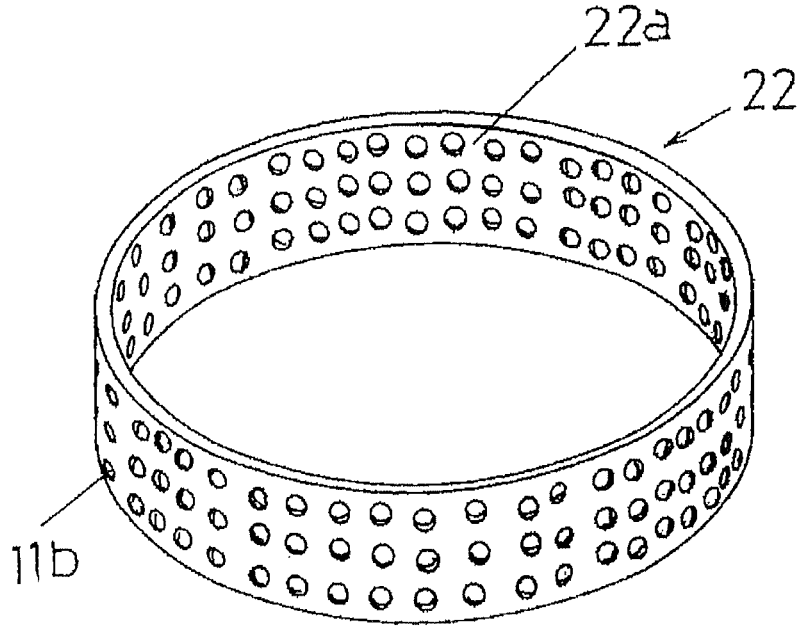
FIG. 16 is an exploded perspective view of the rotor/stator type mixer including the mixer unit shown in FIG. 15.
Figure 16:
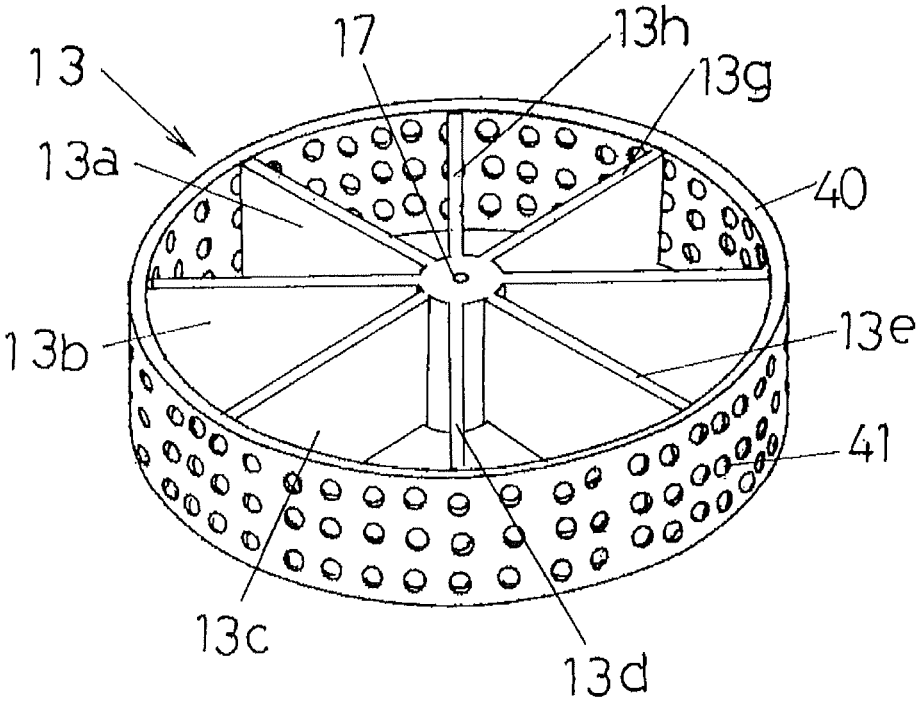

The mixer unit 14 in the rotor/stator type mixer according to the present invention includes the rotor 13 and the stator 22 which are constructed as shown in FIG. 16 and the stator 22.

The stator 22 has a plurality of openings 11*b* formed thereon, each being formed like a round shape just like the stator 2 in the prior art mixer 4 shown as an example in FIG. 1.

Figure 15:
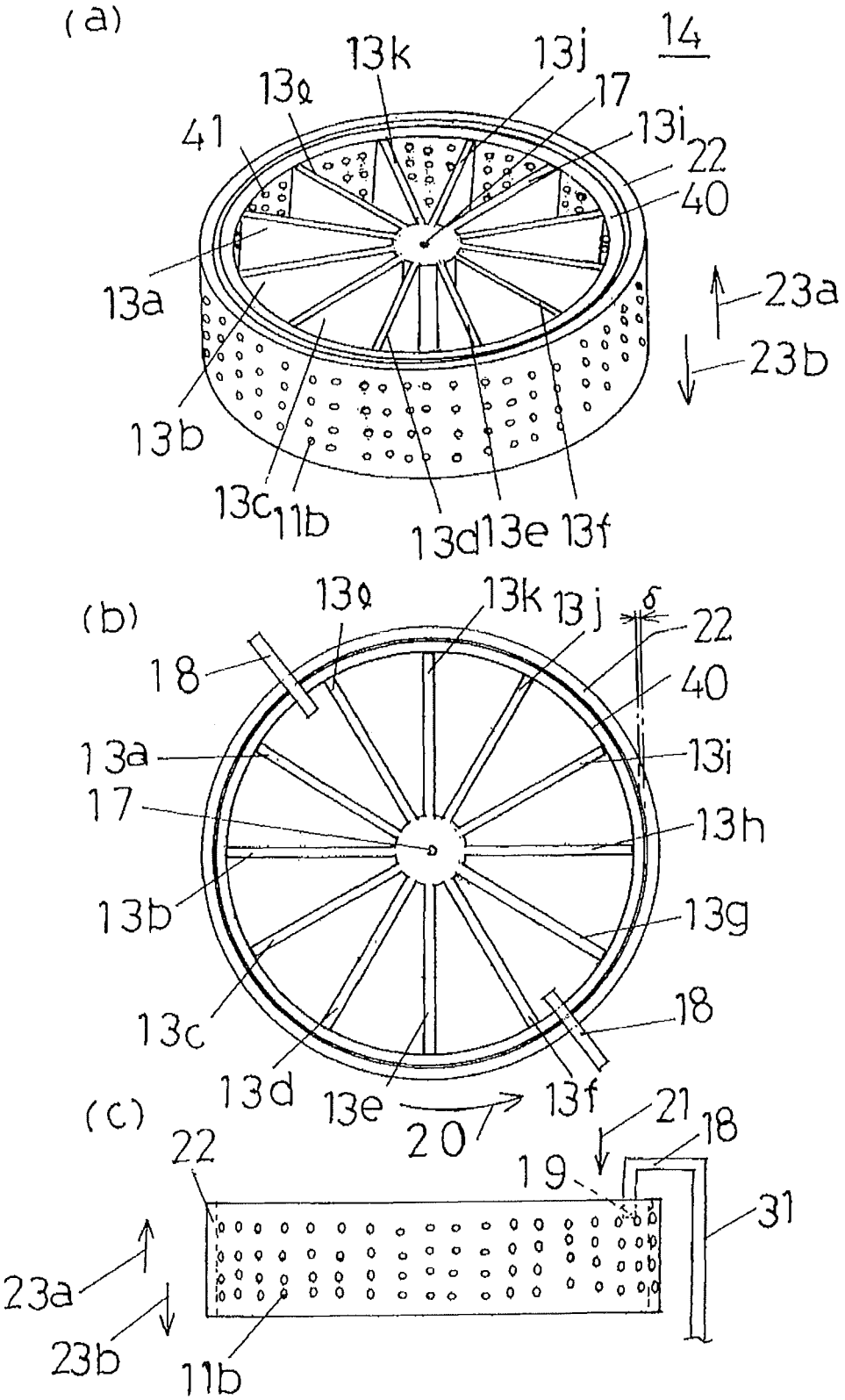
FIG. 15 illustrates one example of the mixer unit that may be employed by the rotor/stator type mixer according to the present invention, in which (a) is a perspective view, (b) is a plan view and (c) is a side view.

The rotor 13 that is disposed inwardly radially of the stator 22 and spaced away from the stator 22 with a specific gap includes a rotary shaft 17 and has a plurality of agitating blades extending radially from the rotary shaft 17 so that they can rotate about the center point of the rotary shaft 17. It is noted that FIG. 15 illustrates the embodiment in which twelve (12) agitating blades 13*a* to 13*l* are provided and that FIG. 16 illustrates the embodiment in which eight (8) agitating blades 13*a* to 13*h* are provided. Herein, those agitating blades 13*a* to 13*l* will be referred collectively to as the "agitating blades 13".

A rotor peripheral wall 40 is arranged at the forward end of each of the agitating blades 13. The outer periphery of the rotor peripheral wall 40 is located so that it can face opposite the inner peripheral wall 22*a* of the stator 22, and a gap δ is formed between the outer periphery of the rotor peripheral wall 40 and the inner peripheral wall 22*a* of the stator 22 as shown in FIG. 15 (*b*).

The rotor peripheral wall 40 has a plurality of openings 41 formed thereon. Each of the rotor openings 41 may have the same diameters as that of each of the openings 11*b* formed on the stator 22. The frequency with which the openings 41 are formed on the rotor peripheral wall 40 may be substantially the same as the frequency with which the openings 11*b* are formed on the stator 22.

When the rotor 13 is driven so that it can be rotated about the center point of the rotary shaft 17 as indicated by an arrow 20, the rotor peripheral wall 40 on which the plurality of rotor openings 41 are formed will be moved in the radial direction toward the stator 22 on which the plurality of openings 11*b* are formed so that they can face opposite each other with the specific gap δ, where the rotor peripheral wall 40 will be rotated as the rotor 13 is driven for rotation. Then, an effective mixing section will be formed there. This can improve the shearing stress applied to the fluid being processed.

In the mixer of the present invention, the stator 22 and the rotor 13 can be brought closer to or farther away from each other in the direction in which the rotary shaft 17 of the rotor 13 extends. In the embodiment shown, the rotor 13 is capable of moving in the direction in which the rotary shaft 17 extends as indicated by the two opposite arrows 23*a* and 23*b* in FIG. 15 (*a*).

At the initial stage where a powdery material will be dissolved by the mixer, the rotor 13 may be moved away from the stator 22 as indicated by an arrow 23*b* in 15 (*a*). During this stage, the powdery material can be diffused quickly into a prepared liquid without causing the high energy being dissipated.

Then, the rotor 13 may be moved as indicated by an arrow 23*a* in FIG. 15 (*a*). In this way, the total area of the rotor peripheral wall 40 having the plurality of openings 11*b* formed thereon will be located so that they can face opposite the total area of the stator 22 having the plurality of openings 116*b* formed thereon. Thus, the mixing section described above will be created therebetween. By driving the rotor 13 to rotate as indicated by an arrow 20 in FIG. 15, the procedure of dissolving, particle size breaking up and emulsifying the powdery material will be initiated actually.

It may be apparent from the foregoing description that the stator 22 and the rotor 13 are capable of moving closer to or farther away from each other. Thus, the gap between the stator 22 and the rotor 13 can be changed or controlled while the rotor 13 is being rotated. In this way, the shearing stress applied to the fluid being processed can be changed or adjusted or the flow rate at which the fluid being processed is flowing can be changed or adjusted.

In accordance with the mixer of the present invention as illustrated in FIG. 15 (*a*) to (*c*), a nozzle 18 is provided along the top end of the stator 22 comprising the mixer unit 14 so that it can extend radially toward the center. Then, the fluid being processed may be fed directly into the mixing section through the nozzle 18 and its opening 19 as indicated by an arrow 21 in FIG. 15 (*c*).

More specifically, the fluid being processed may be flowing inwardly radially of the rotor peripheral wall 40 having the plurality of openings 41 formed thereon so that it can be fed directly through the nozzle's opening 19 as indicated by the arrow 21. The fluid being processed that is flowing though the plurality of openings 41 on the rotor peripheral wall 40 that is now being driven for rotation in the direction of the arrow 20 may then flow through the plurality of rotor openings 41 into the mixing section created by the gap δ between the rotor peripheral wall 40 and the rotor 22 facing opposite the rotor peripheral wall 40 radially and the fluid being processed will finally be mixed in the mixing section.

In this way, the fluid being processed may be fed (added) directly into the mixing section where the emulsification or diffusion will be performed effectively.

Figure 17:
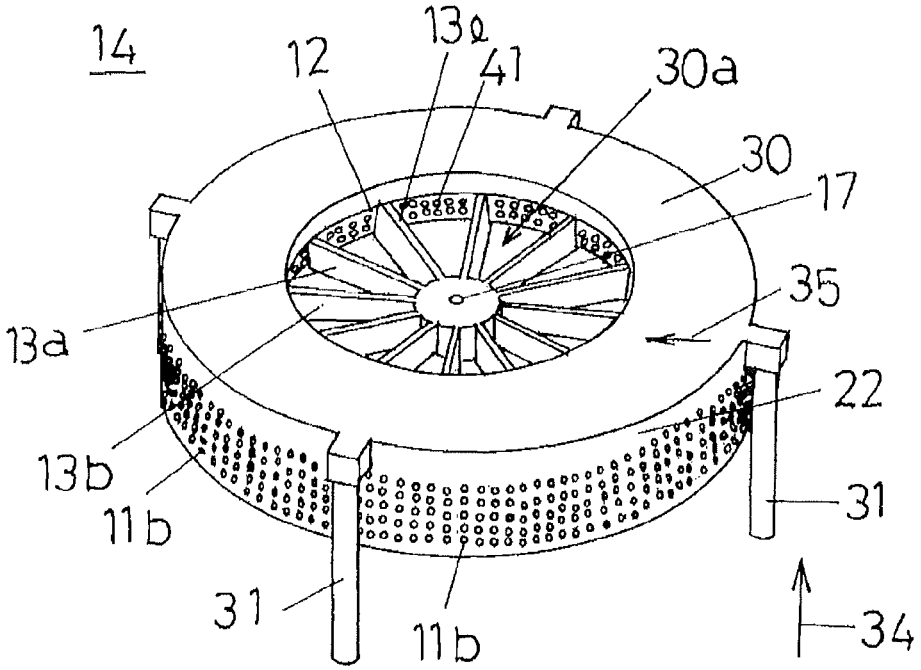
FIG. 17 illustrates another mixer unit that may be employed by the rotor/stator type mixer according to the present invention.
Figure 18:
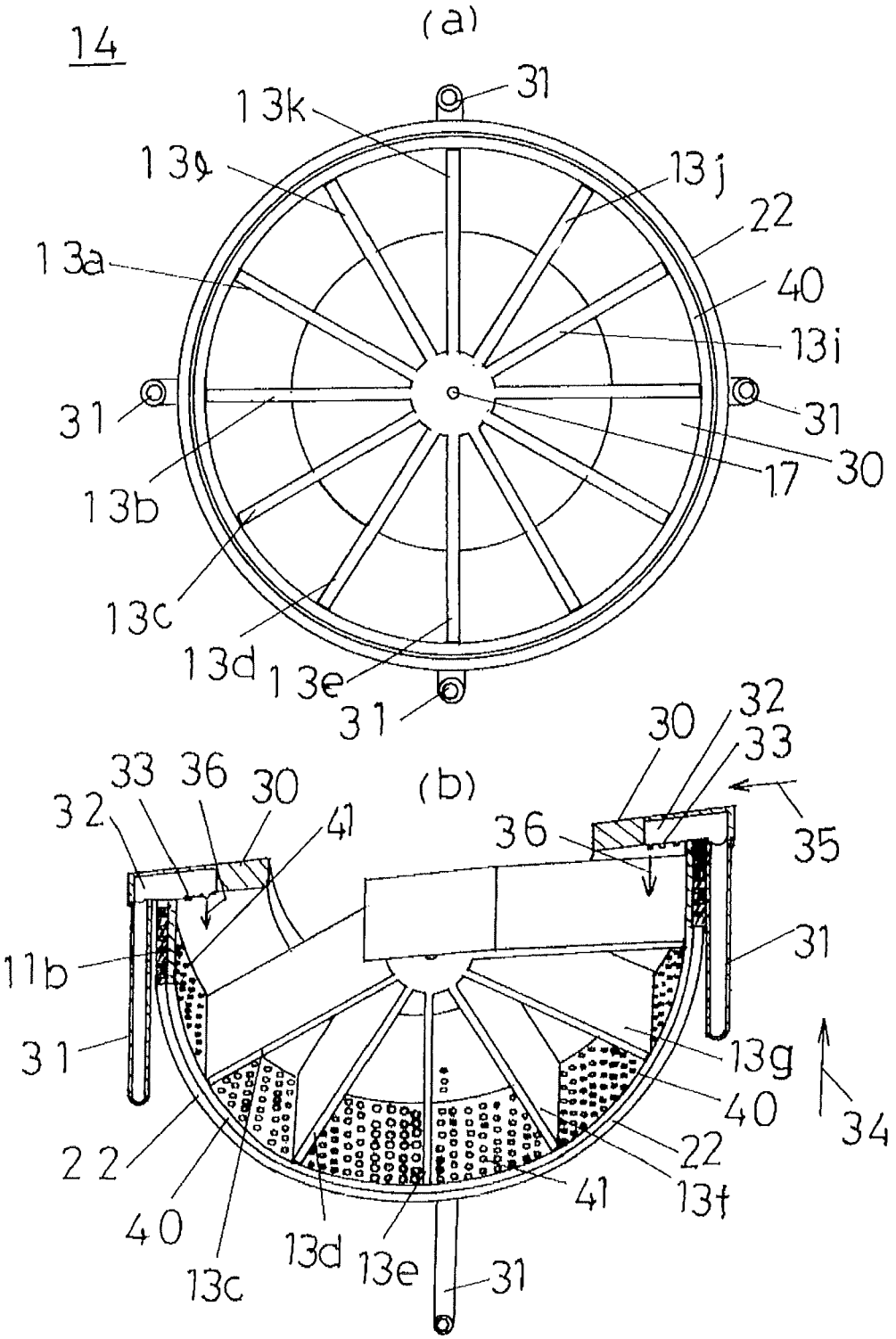
FIG. 18 illustrates the mixer unit shown in FIG. 17, in which (a) is a bottom view and (b) is a perspective view of the mixer unit as viewed diagonally in the downward direction with some parts being omitted.

FIG. 17 and FIG. 18 (*a*), (*b*) illustrate a variation of the preceding embodiment described by using FIG. 15 (*a*) to (*c*) and FIG. 16. This current embodiment differs from the preceding embodiment in FIG. 15 (*a*) to (*c*) and FIG. 16 in that the stator 22 has an annular cover 30 extending inwardly radially of its top end edge. The difference from the preceding embodiment will be described below.

It may be noted that the embodiment shown in FIG. 17 and FIG. 18 (*a*), (b) includes the twelve (12) agitating blades 13*a* to 13*l* that extend radially from the rotary shaft 17

In accordance with the embodiment shown in FIG. 17 and FIG. 18 (*a*), (*b*), the annular cover 30 is provided so that it can extend inwardly radially from the top end edge of the stator 22. Thus, the fluid being processed can be prevented from leaking from the gap between the rotor 13 and the stator 22 toward the upper end side in FIG. 15 (*a*).

In the embodiment in which the annular cover 30 is provided as shown in FIG. 17 and FIG. 18 (*a*), (*c*), the direct feeding (adding) mechanism described in FIG. 15 (*b*), (*c*) has the construction that allows the annular cover 30 to be utilized.

In addition, an inlet conduit 31 is provided around the outer periphery of the stator 22 so that it can extend in the direction in which the rotary shaft extends, and a conduit 32 that communicates with the top end of the inlet conduit 31 is provided so that it can extend inwardly radially within the cover 30. The annular cover 30 that is located inwardly radially from the rotor peripheral wall 40 has inlet holes 33 formed thereon through which the fluid being processed is flowing so that it can be directed downwardly as shown in FIG. 18 (*b*). The conduit 32 extending inwardly radially within the cover 30 is connected with the inlet holes 33. In this way, the fluid being processed may be introduced (added) through the inlet conduit 31, the conduit 32 and the inlet holes 33 as indicated by arrows 34, 35, 36.

Figure 14:
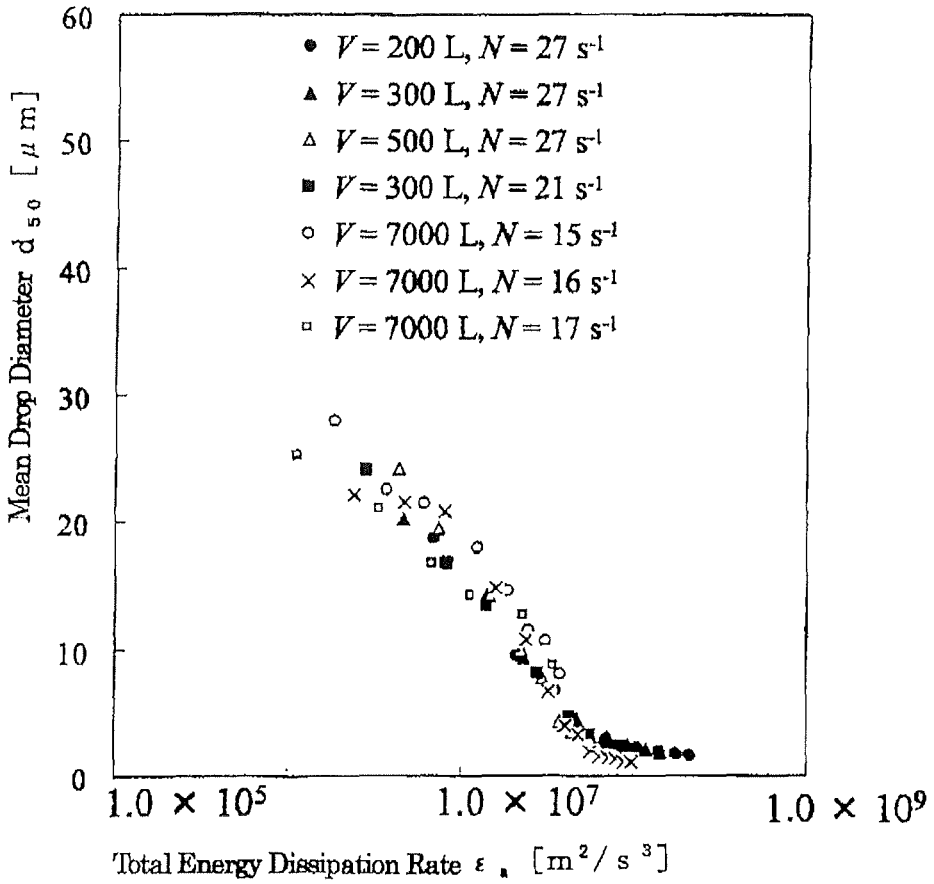
FIG. 14 represents the relationship between the total energy dissipation rate: $\epsilon_a$ and the resulting liquid drop diameters (particle size breakup trend) under the running condition presented in Table 5 for anther large size mixer.

The presence of the cover 30 prevents the fluid from leaking through the gap between the rotor 13 and the stator 22 and flowing upwardly in FIG. 14, so that the fluid can be allowed to pass through the openings 41 on the rotor peripheral wall 40 and the openings 11*b* on the stator 22, flowing radially from the inside toward the outside. This allows the fluid being process to receive the high shearing stress.

Like the mixer in the preceding embodiment shown in FIG. 15 (*a*) to FIG. 16, the mixer in the current embodiment shown in FIG. 17 and FIG. 18 also allows the gap between the stator 22 and the rotor 13 to be adjusted or controlled while the rotor 13 is being rotated. Thus, the shearing stress applied to the fluid being processed can be changed or adjusted and the flow rate at which the fluid being processed is flowing can be changed or adjusted.

Figure 19:
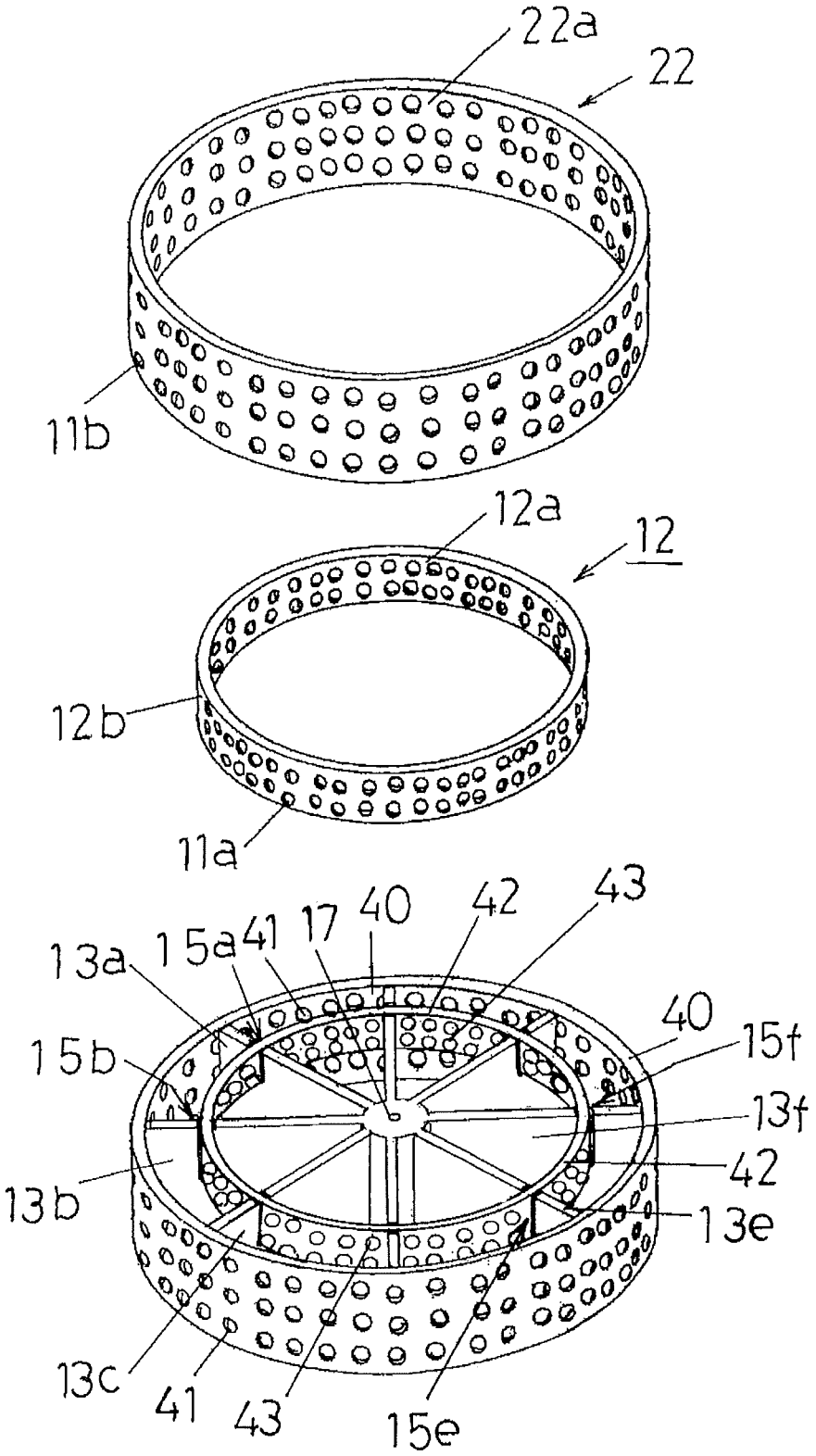
FIG. 19 is a perspective view of still another mixer unit employed by the rotor/stator type mixer according to the present invention in which the rotor and the stator are separated from each other.
Figure 20:
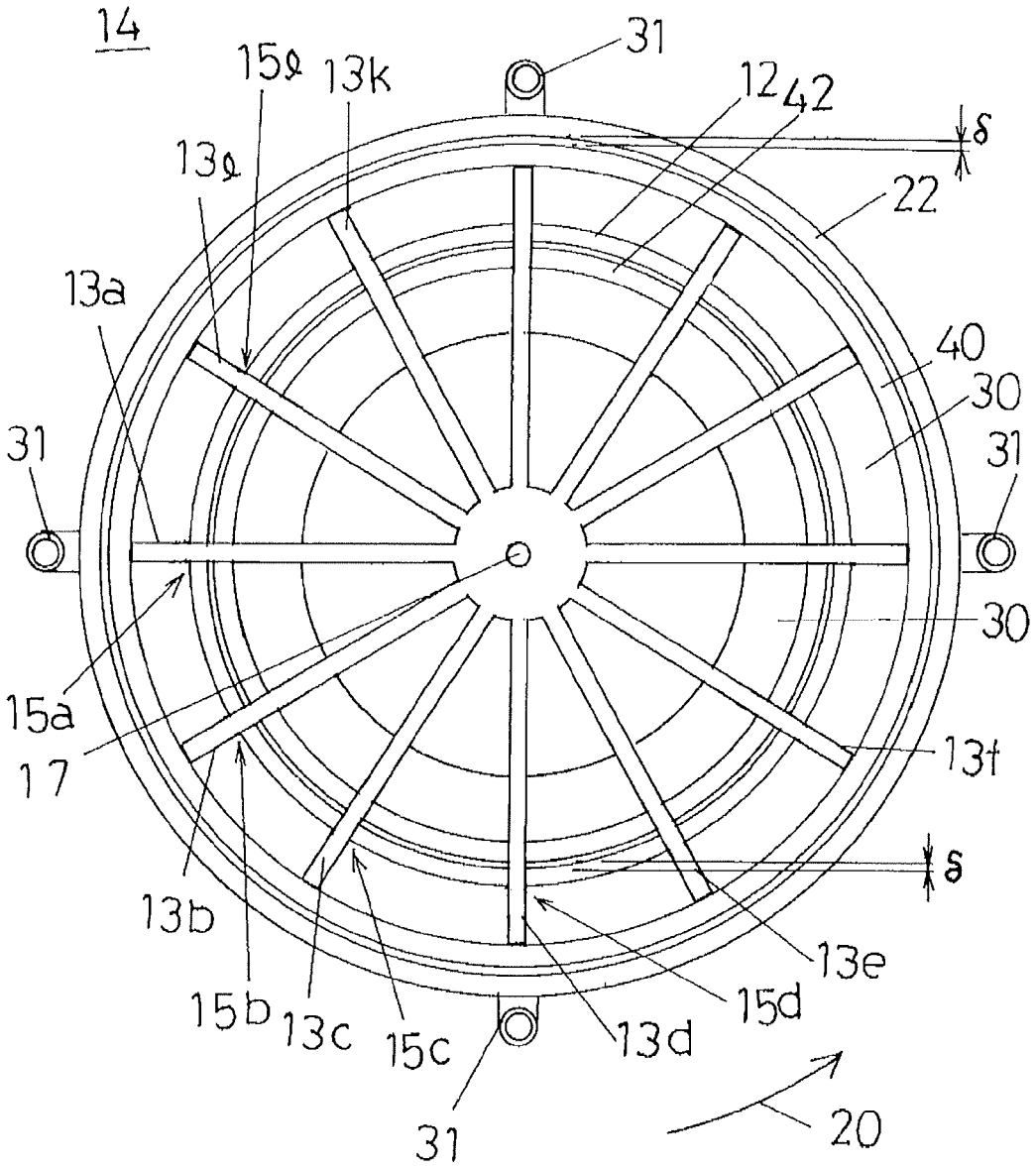
FIG. 20 is a bottom view of another embodiment of the mixer unit of the type illustrated in FIG. 19.
Figure 21:
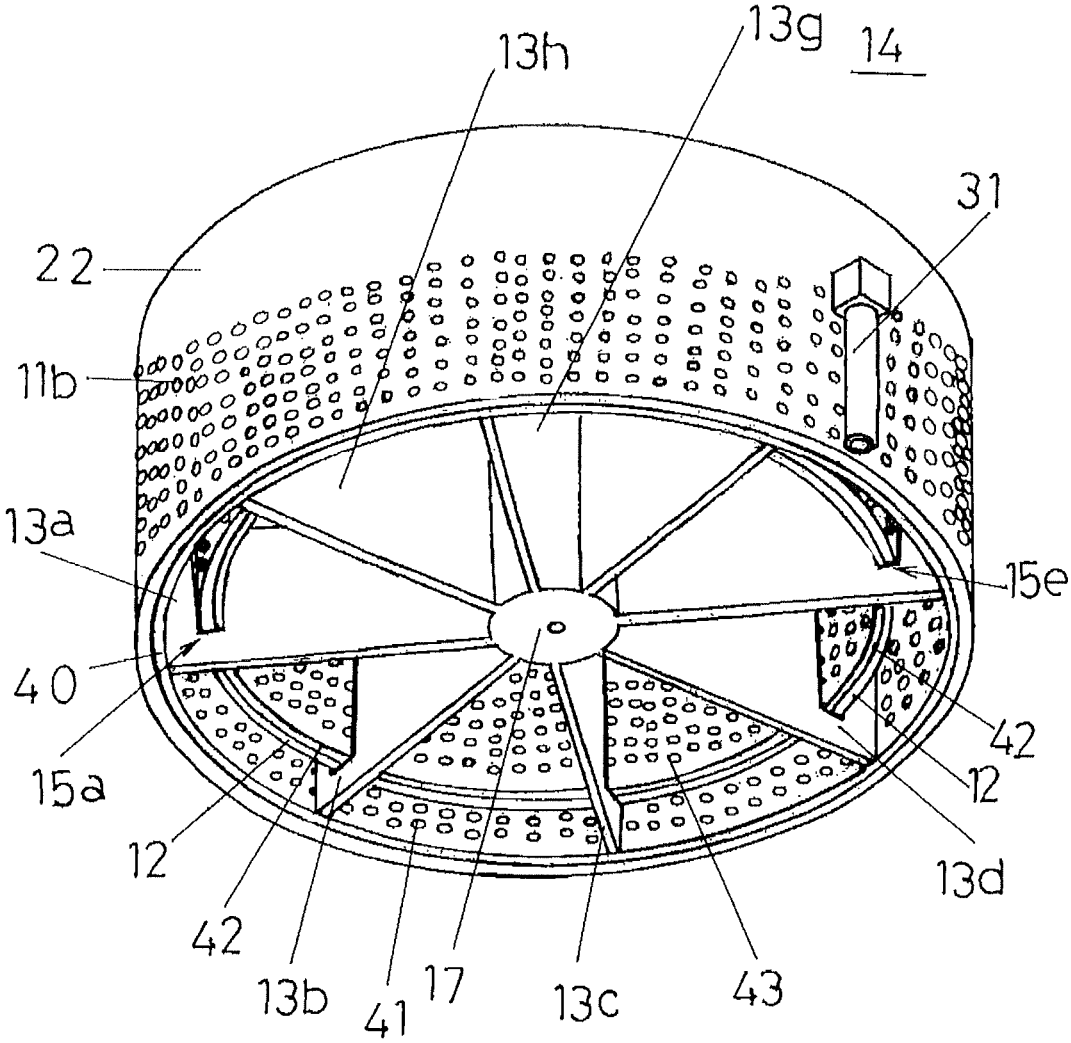
FIG. 21 is a perspective view of the mixer unit of the type shown in FIG. 20 as viewed diagonally in the downward direction.
Figure 22:
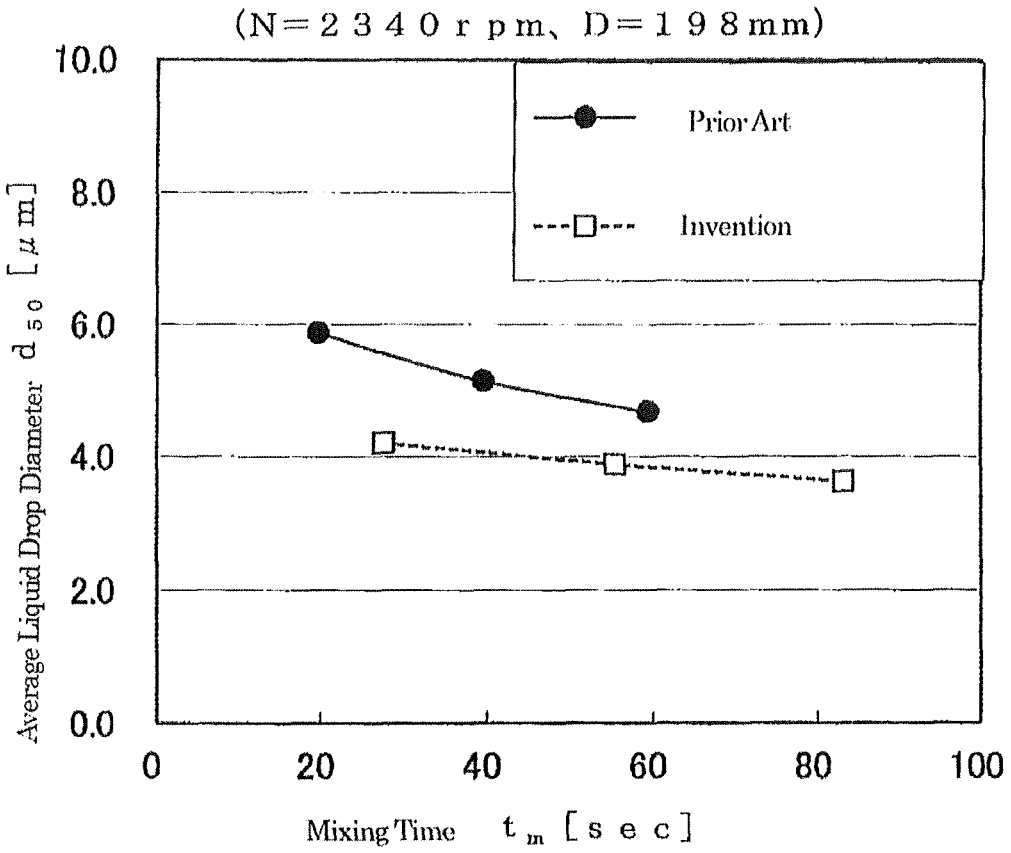
FIG. 22 represents the testing results obtained by comparing the prior art mixer and the inventive mixer in which the respective relationships between the mixing time and the resulting average liquid drop diameters are represented.
Figure 23:
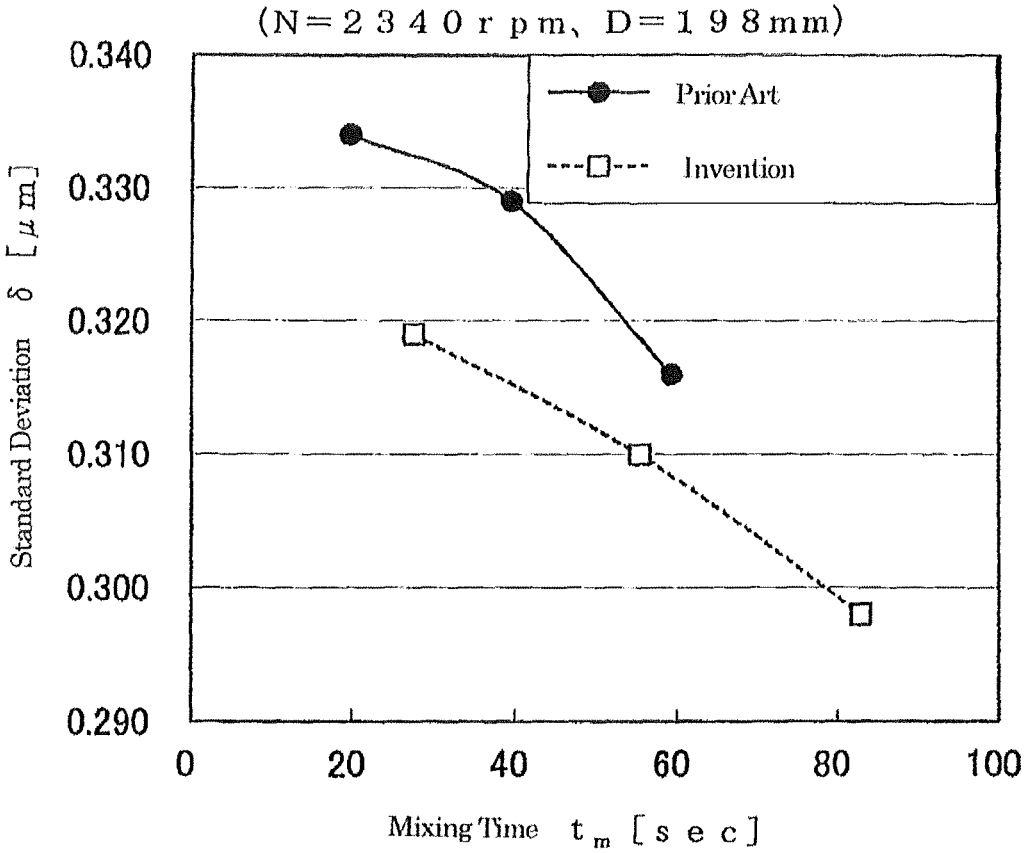
FIG. 23 represents the testing results obtained by comparing the prior art mixer and the inventive mixer in which the respective relationships between the mixing time and the standard deviation are represented.
Figure 24:
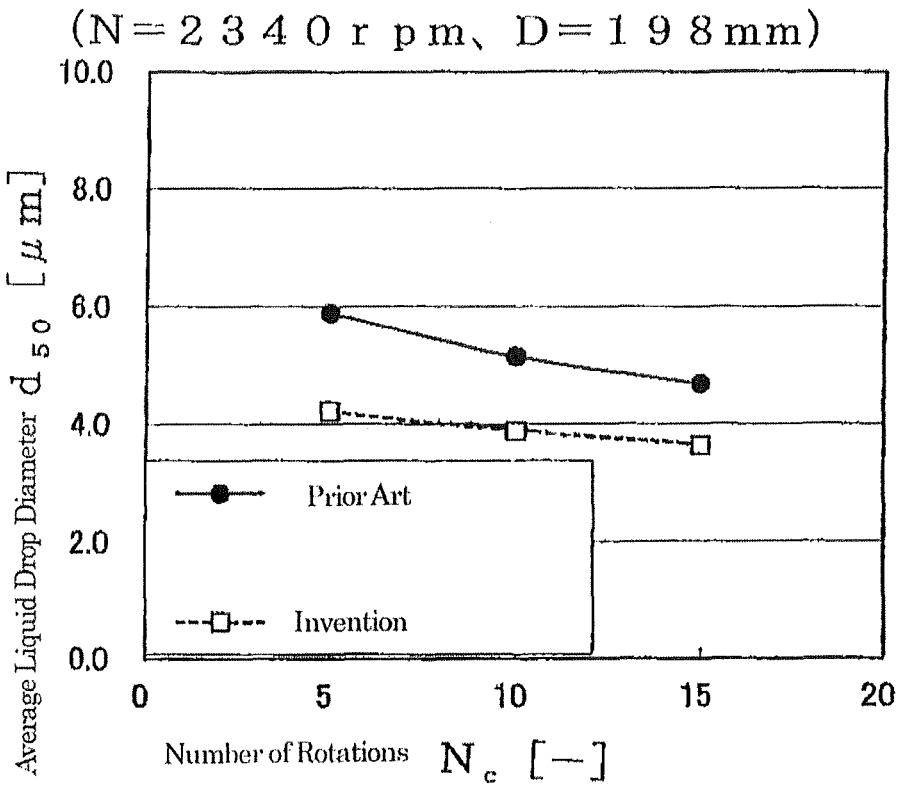
FIG. 24 represents the testing results obtained by comparing the prior art mixer and the inventive mixer in which the respective relationships between the mixing time and the resulting average liquid drop diameters are represented.
Figure 25:
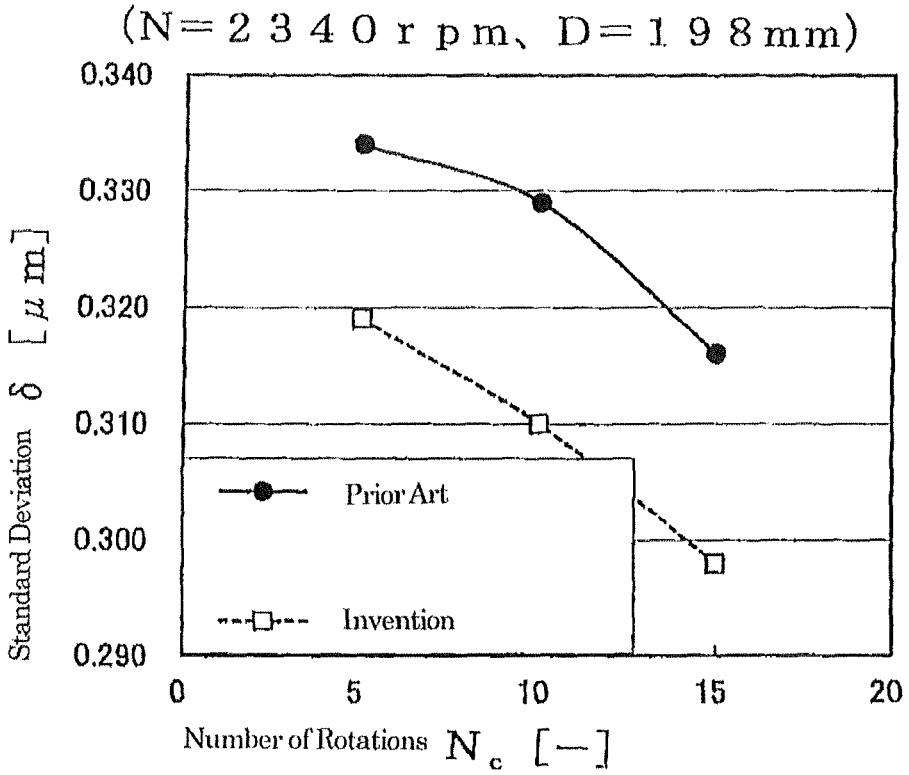
FIG. 25 represents the testing results obtained by comparing the prior art mixer and the inventive mixer in which the respective relationships between the number of rotor rotations and the standard deviation are represented.
Figure 26:
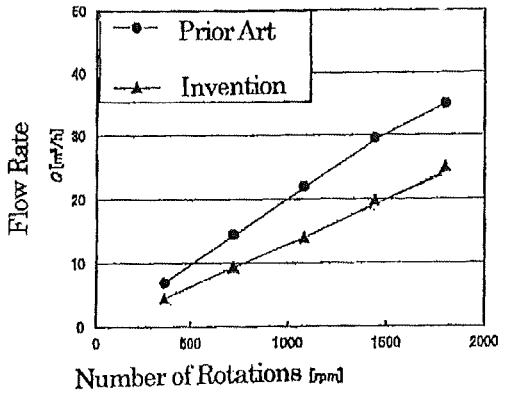
FIG. 26 represents the testing results obtained by comparing the prior art mixer and the inventive mixer in which (a) represents the respective relationships between the number of rotor rotations and the flow rate, (b) represents the respective relationships between the number of rotor rotations and the driving powers and (c) represents the respective relationships between the number of rotor rotations and the driving powers contributing to the emulsification.
Figure 26:
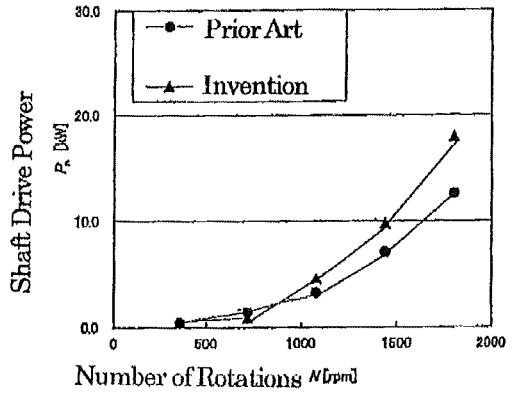
Figure 26:
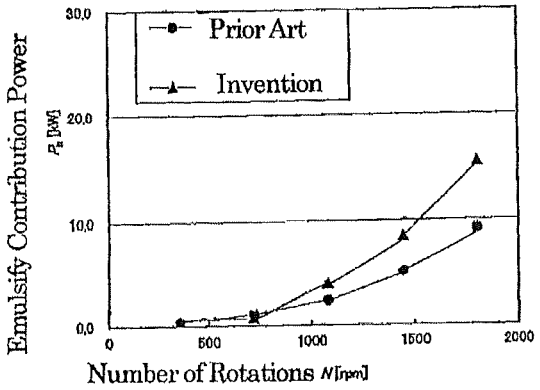

FIG. 19 to FIG. 21 illustrate another embodiment that is a further variation of the embodiment described above by using FIG. 15 and FIG. 16. This embodiment differs from the preceding embodiment in FIG. 15 (*a*) to (*c*) in that it includes a multistage mixing section that is composed of a mixing portion located inwardly radially and a mixing portion located outwardly radially, the mixing section being created when the rotor 13 is rotated about the center point of the rotary shaft 17 as indicated by the arrow 20. Now, the difference from the preceding embodiment will be described below.

It is noted that the embodiment shown in FIG. 19 and FIG. 21 includes the eight (8) agitating blades 13*a* to 13*h* whereas the embodiment shown in FIG. 20 includes the twelve (12) agitating blades 13*a* to 13*l*. Each of those embodiments is now described below.

In the embodiment shown in FIG. 19 and FIG. 21, multiple stators are provided in which one stator 12 whose diameter is smaller than the other stator 22 is located inwardly radially of the stator 22 so that the two stators can be disposed co-centrically within the mixer unit 14 as shown in FIG. 20.

As one example of the embodiment in which the multiple stators each having a different diameter are arranged co-centrically, it may be constructed such that the top end edge of the smaller diameter stator 12 than the stator 22 can be mounted beneath the annular cover 30 extending inwardly radially from the top end edge of the stator 22 as shown in FIG. 20.

The rotor 13 that may be disposed inwardly of the stator 22 with a specific gap includes a plurality of agitating blades 13 extending radially from the center point of the rotary shaft 17 about which the rotor 13 is driven for rotation.

As described in relation to the embodiment shown FIG. 15 (*a*) to (*c*) and FIG. 16, the plurality of rotor openings 41 are provided at the forward ends of the agitating blades 13, and the rotor peripheral wall 40 is provided so that it can face opposite the inner wall side 22*a* of the stator 22.

The rotor peripheral wall 42 having the plurality of rotor openings 43 formed thereon and facing opposite the inner wall side 12*c* of the inner stator 12 is disposed on the middle way of the agitating blades 13.

A plurality of longitudinal grooves 15*a*, 15*b*, 15*c*, 15*d*, . . . , 15*l* are provided on the same radial position between the radial center of each of the agitating blades 13 and the radial outer end thereof. Herein, those longitudinal grooves 15*a*, etc. will be referred to collectively as the "longitudinal grooves 15".

As described previously, the rotor peripheral wall 42 having the smaller diameter than the rotor peripheral wall 40 and facing opposite the same is provided inwardly radially of the position in which the longitudinal grooves 15 are provided on the agitating blades 13, and it supported by the agitating blades 13.

The rotor peripheral wall 42 has a plurality of rotor openings 43 formed thereon. The size (diameter) of each of the rotor openings 43 may be the same as that of each of the openings 11*a* formed on the stator 12. The frequency with which the rotor openings 43 are formed on the rotor peripheral wall 42 may also be virtually the same as the frequency with which the openings 11*a* are formed on the stator 12.

When the mixer unit 14 is being formed as shown in FIG. 21, the stator 12 will be fitted into the longitudinal grooves 15 formed on the agitating blades 13. Then, one gap δ will be formed between the peripheral wall side of the rotor peripheral wall 42 and the inner peripheral wall side 12*a* of the stator 12, another gap δ will be formed between the radial inner side of the longitudinal grooves 15 and the outer peripheral wall side 12*b* of the stator 12, and still another gap δ will be formed between the peripheral wall side of the rotor peripheral wall 40 and the inner peripheral wall side 22*a* of the stator 12*b*.

In the mixer unit 14 of the rotor/stator type mixer as shown in FIG. 19 to FIG. 21, therefore, the rotor has been disposed inwardly of the multiple stators 12 and 22 each having the different diameter so that it can be spaced away from those stators with the specific gap.

When the rotor 13 is then driven so that it can rotate about the center point of the rotary shaft 17 as indicated by the arrow 20, the two-stage mixing section composed of the radially inner mixing portion and the radially outer mixing portion will be created. The higher performance can thus be achieved by the mixing process that is performed by this multistage mixing section. More specifically, the shearing stress applied to the fluid being processed can be improved by this multistage mixing section.

In the embodiment shown and described, the mixing portion located inwardly radially will be formed between the rotor peripheral wall 42 and the inner peripheral wall side 12*a* of the stator 12 and between the inner side of the longitudinal grooves 15 and the outer peripheral wall side 12*b* of the stator 12. The mixing portion located outwardly radially will be formed between the peripheral wall side of the rotor peripheral wall 40 and the inner peripheral wall side 22*a* of the stator 22.

Similarly, in the embodiment shown and described in FIG. 19 to FIG. 21, the stators 12, 22 and the rotor 13 may also be arranged so that the stators 12 and 22 can be brought close to or farther away from the rotor 13 in the direction in which the rotary shaft 17 of the rotor 13 extends. In other words, the stators 12, 22 and the rotor 13 are capable of movement so that the gap between them can be adjusted or controlled while the rotor 13 is being rotated. This allows the shearing stress applied to the fluid being processed to be changed or adjusted, and this also allows the flow rate at which the fluid being processed to be changed or adjusted.

In FIG. 19, the relationship between the stators 12, 22 and the rotor 13 has been described under the assumption that the annular cover 30 is not provided in the mixer. In the embodiment shown and described in FIG. 19 to FIG. 21, the mixer may be constructed so that it can also include the annular cover 30. In FIG. 20, the mixer that includes the annular cover 30 is represented as it is viewed from the underside. The mixer that includes the annular cover 30 can prevent the fluid being processed from leaking through the respective gaps between the stators 12, 22 and the rotor 13 and flowing upwardly in FIG. 21.

For the mixer that includes the annular cover 30, the direct feeding (adding) mechanism described by using FIG. 5 (*a*), (*c*) may be provided such that the annular cover 30 described in FIG. 20 can be utilized. In this case, a conduit 32 extending inwardly radially may be provided inside the annular cover 30, and inlet holes 33 through which the fluid being processed is allowed to flow downwardly may be formed on the underside of the annular cover 30 that is located inwardly radially from the position in which the rotor peripheral wall having the smallest diameter and supported by the agitating blades 13.

(Testing and Studying for Comparison)

Testing was conducted to compare the prior art mixer described in FIG. 1 and the inventive mixer (the mixer that includes the annular cover 30) described in FIG. 21. During this testing process, the external circulation mode unit was provided, the liquid drop diameters on the middle way of the fluid path were measured by using the laser diffraction type particle size analyzer (offered by Shimazu Manufacturing Company under the name of SALD-2000), and by examining the particle size breakup trend for the resulting liquid drop diameters.

Both the stator 2 in the prior art mixer and the stator 22 in the inventive mixer that were used for the testing purpose had the diameter of 197 mm. The testing was conducted by using the butter emulsified liquid having the composition presented in Table 9 below.

| | Composition Ratio (%) | Composition Quantity (g) | FAT | SNF | TS |
|---|---|---|---|---|---|
| Butter | 5.99 | 2995 | 4.95 | 0.07 | 5.02 |
| Powdered Skim Milk | 5.16 | 2580 | 0.05 | 4.93 | 4.98 |
| Water | 88.85 | 44425 | | | |
| Total | 100 | 50000 | 5.00 | 5.00 | 10.00 |

The results obtained by this testing are presented in Table 10, Table 11 and FIG. 20 to FIG. 28. From FIG. 20, it has been confirmed that the mixer of the present invention provides the trend in which the equivalent particle size breakup can be performed in less time than the mixer of the prior art. From FIG. 21, it has also been confirmed that the mixer of the present invention provides the liquid drop diameters which are varied less than the mixer of the prior art, and from FIG. 24 (*c*), it has also been confirmed that in the mixer of the present invention, the rotation of the rotor contributes to driving the emulsification more than in the mixer of the prior art.

| | | | Particle Size (μm) | | | | |
|---|---|---|---|---|---|---|---|
| | | pass | Mean Particle Size | Standard Deviation | Median Diameter | Mode Diameter | Time [sec] |
| Butter Emulsion (1 hr) | Prior Art | 5 | 5.880 | 0.334 | 7.142 | 9.219 | 19.8 |
| | | 10 | 5.149 | 0.329 | 6.314 | 7.486 | 39.6 |
| | | 15 | 4.677 | 0.316 | 5.784 | 7.486 | 59.3 |
| | Invention | 5 | 4.370 | 0.322 | 5.218 | 7.486 | 28.8 |
| | | 10 | 3.921 | 0.312 | 4.533 | 6.078 | 57.7 |
| | | 15 | 3.657 | 0.304 | 4.114 | 6.078 | 86.5 |

Prior Art

| Frequency [Hz] | Number of rotations [rpm] | Flow rate [$m^3$/h] | Current Value [A] | Torque [N · m] | Shift Drive Power [kW] | Pump Power [kW] | Emulsify Contribution Power [kW] | Notes |
|---|---|---|---|---|---|---|---|---|
| 10 | 360 | 7 | 5.04 | 12 | 0.5 | 0.0 | 0.4 | |
| 20 | 720 | 14.6 | 6.01 | 19 | 1.4 | 0.2 | 1.2 | |
| 30 | 1080 | 22 | 8.1 | 29 | 3.3 | 0.8 | 2.5 | |
| 40 | 1440 | 29.5 | 11.6 | 47 | 7.1 | 1.8 | 5.3 | |
| 50 | 1800 | 35 | 16.6 | 67 | 12.6 | 3.4 | 9.2 | 10 min Temperature rising 18° C. |
| 65 | 2340 | 45.5 | | | | | | |

| pass[sec/pass] | | | |
|---|---|---|---|
| 1 | 5 | 10 | 15 |
| 4.0 | 19.8 | 39.8 | 59.3 |

Invention

| Frequency [Hz] | Number of rotations [rpm] | Flow rate [$m^3$/h] | Current Value [A] | Torque [N · m] | Shift Drive Power [kW] | Pump Power [kW] | Emulsify Contribution Power [kW] | Notes |
|---|---|---|---|---|---|---|---|---|
| 10 | 390 | 4.5 | 5.3 | 13 | 0.5 | 0.0 | 0.5 | |
| 20 | 720 | 9.5 | 6.9 | 12 | 0.9 | 0.1 | 0.8 | |
| 30 | 1080 | 14 | 10.4 | 41 | 4.8 | 0.5 | 4.1 | |

-continued

| Invention | | | | | | | | |
|---|---|---|---|---|---|---|---|---|
| 40 | 1440 | 19.8 | 15.8 | 65 | 9.8 | 1.2 | 8.6 | |
| 50 | 1800 | 25 | 22.8 | 95 | 17.9 | 2.4 | 15.5 | 10 min Temperature rising 32° C. |
| 65 | 2340 | 32.5 | | | | | | |

| pass[sec/pass] | | | |
|---|---|---|---|
| 1 | 5 | 10 | 15 |
| 5.5 | 27.7 | 55.4 | 83.1 |

Figure 28:
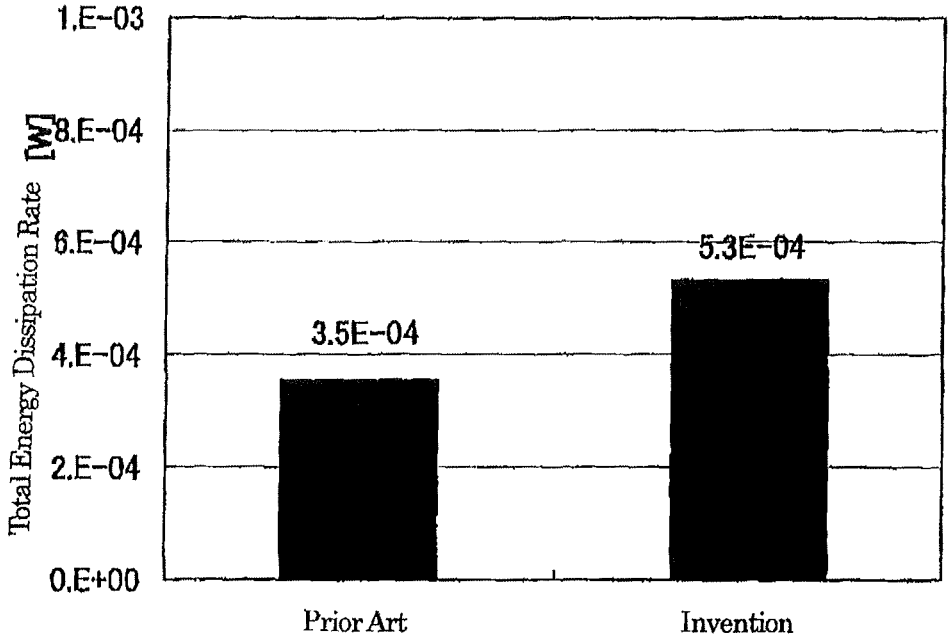
FIG. 28 represents the results obtained by analyzing the energy dissipation rates numerically for the prior art mixer and the inventive mixer.

FIG. 28 presents the results obtained by analyzing the energy dissipation rate and then studying it. From FIG. 28, it is appears that the mixer of the present invention provides the higher energy dissipation rate, more specifically, the higher ability than the mixer of the prior art. From this, it may be estimated that the mixer of the present invention provides the particular size breakup effect that is equivalent to that of the mixer of prior art but can be achieved in less time. The actual particle size breakup trend shown in FIG. 20 is similar to the trend shown by the numerically analyzed results.

Figure 27:
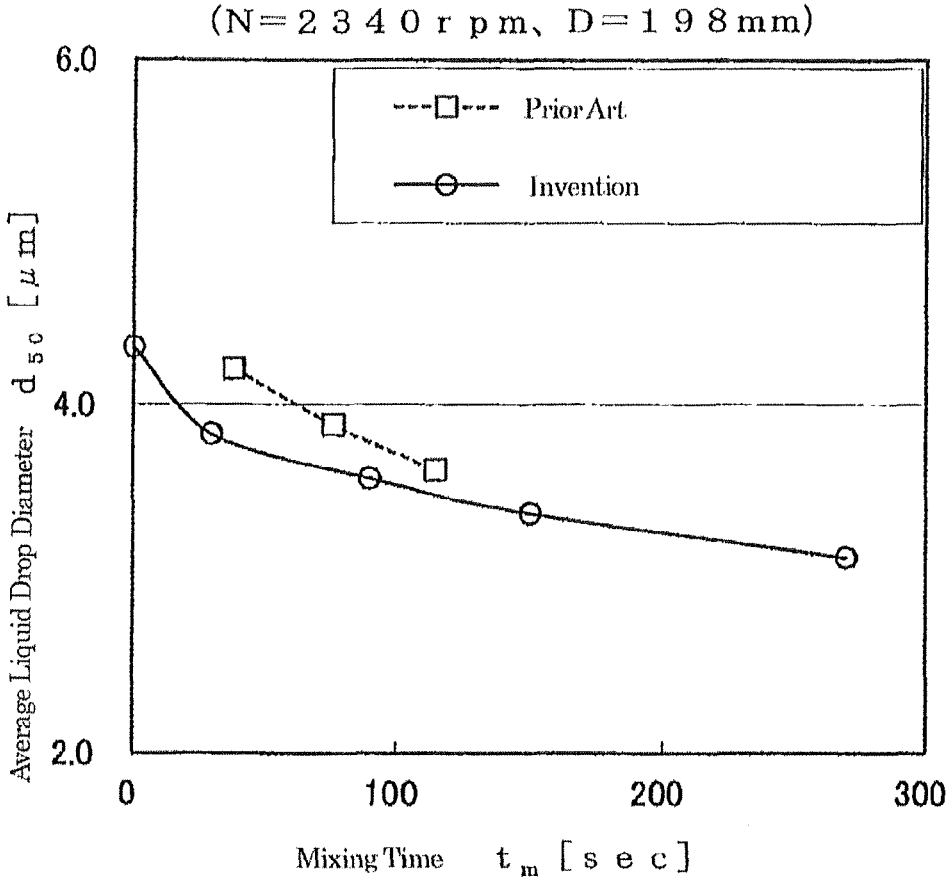
FIG. 27 represents the respective testing results obtained by comparing the case where the fluid being processed has been fed (added) directly into the mixing section in the inventive mixer against the case where it has not been fed (added)

In the mixer of the present invention (in which the annular cover 30 is provided) described by using FIG. 21, FIG. 27 presents the results obtained in the case where the fluid being processed has been fed (added) directly as described in FIG. 18 (*b*) versus the results obtained in the case where the fluid being processed is not fed directly but it is allowed to flow through the inlet holes formed on the annular cover 30 as indicated by the arrow 30*a* in FIG. 17. By simply changing the condition, that is, whether the fluid being processed should be fed (added) directly or it should be allowed to flow through the inlet holes 30*a* on the annular cover 30 with the other running conditions remaining to be unchanged, the study was conducted for the comparison purposes.

As the result, it has been confirmed that the direct feeding (adding) of the fluid being processed as described in FIG. 18 (*b*) provides the higher particle size breakup effect (performance).

The present invention provides the excellent advantages and features that will described below. As such, the present invention can be utilized in the many different industrial fields, such as the foods, pharmaceutical medicines, chemical products or other similar manufacturing fields, in which the emulsification, diffusion, particle size breakup and other processes are performed.

(1) The rotor/stator type mixer of the present invention provides the higher particle size breakup or emulsification effect than the typical high performance rotor/stator type mixer of the prior art, allowing the high quality products to be manufactured.

(2) The rotor/stator type mixer of the present invention provides the higher particle size breakup or emulsification effect, allowing the higher quality products to be manufactured in less time than the prior art mixer.

(3) Many different rotor/stator type mixers ranging from the small to large scales can be scaled up or scaled down by considering the processing (manufacturing) time.

(4) In order to offer any of the particle size breakup effects that meet with each user's needs, the time required for the processing (agitating) purposes can be estimated so that the minimum running time can be achieved. Thus, the running time required for the rotor/stator type mixer can be reduced and the power energy required for the running time can be saved accordingly.

The following is a list of the reference numerals referred to in the specification:

1 Opening (hole)
2 Stator
3 Rotor
4 Mixer Unit
11*a*, 11*b* Openings
12, 22 Stators
13 Rotor
13*a*, 13*b*, 13*c*, 13*d*, 13*e*, 13*f*, 13*g*, 13*h*, 13*j*, 13*k* Agitating blades
14 Mixer Unit
15 Longitudinal Grooves
17 Rotary Shaft
18 Nozzle
19 Nozzle Opening
30 Annular Cover
31 Inlet Conduit
33 Inlet Hole

The invention claimed is:

1. A rotor/stator type mixer comprising a mixer unit that includes a stator having a plurality of openings formed thereon and a rotor disposed inwardly radially of the stator and spaced away from the stator with a specific gap, wherein the rotor disposed inwardly radially of the stator and spaced away from the stator with the specific gap includes:

a rotor peripheral wall that is supported by a plurality of agitating blades extending radially from the center point of a rotary shaft of the rotor and faces opposite the inside of the peripheral wall of the stator having the plurality of openings formed thereon and is located inwardly radially of the stator with the specific gap; and a plurality of rotor openings formed on the rotor peripheral wall;

wherein the mixer is designed by calculating the Equation 1 listed below to estimate the mixer's particular running time and the resulting liquid drop diameters of the fluid being processed that are obtained during that mixer's particular running time, the mixer's design being such that it allows the resulting liquid drop diameters of the fluid being processed to be determined during the mixer's particular running time:

$$\varepsilon_a = \varepsilon_g + \varepsilon_s \qquad \text{Equation 1}$$

$$= [(N_p - N_{qd}\pi^2)\cdot n_r]\left\{D^3\left[\frac{\left(\frac{D^3 b}{\delta(D+\delta)}\right) + \frac{\pi^2 n_s^2 d^3(d+4\ell)}{4N_{qd}\left[\begin{matrix} n_s\cdot d^2 + \\ 4\delta(D+\delta)\end{matrix}\right]}}{}\right]\right\}\left(\frac{N^4\cdot t_m}{V}\right)$$

-continued $$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$. Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b: Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer.

2. A rotor/stator type mixer as defined in claim 1, wherein the stator includes a plurality of stators each having a different peripheral diameter and wherein the rotor peripheral wall of the rotor disposed inwardly radially of each of the stators is disposed so that it can be spaced away from each of the stators with a respective specific gap.

3. A rotor/stator type mixer as defined in claim 1, wherein the stator and the rotor are provided so that they can be brought closer to or farther away from each other in the direction in which the rotary shaft of the rotor extends.

4. A rotor/stator type mixer as defined in claim 1, wherein the stator has an annular cover extending inwardly radially from an edge of a top end edge.

5. A rotor/stator type mixer as defined in claim 4, wherein the annular cover has an inlet hole through which a fluid being processed can be introduced downwardly.

6. A rotor/stator type mixer as defined in claim 1, wherein each of the plurality of openings formed on the stator has a round shape.

7. A rotor/stator type mixer as defined in claim 1, wherein the plurality of openings formed on the stator represent over 20% of the total peripheral wall of the stator when it is expressed in terms of the opening-to-area ratio.

8. A method of manufacturing foods, pharmaceutical medicines or chemical products by using a rotor/stator type mixer comprising a mixer unit that includes a stator having a plurality of openings formed thereon and a rotor disposed inwardly radially of the stator and spaced away from the stator with a specific gap in which the rotor disposed inwardly radially of the stator and spaced away from the stator with the specific gap includes:

a rotor peripheral wall that is supported by a plurality of agitating blades extending radially from the center point of a rotary shaft of the rotor and faces opposite the inside of the peripheral wall of the stator having the plurality of openings formed thereon and is located inwardly radially of the stator with the specific gap; and a plurality of rotor openings formed on the rotor peripheral wall; and the fluid being processed is subjected to the emulsifying, dispersing, particle size breaking up or mixing operation, wherein the foods, pharmaceutical medicines or chemical products are manufactured by calculating the Equation 1 listed below to estimate the mixer's particular running time and the resulting liquid drop diameters obtained during that mixer's particular running time:

$$\varepsilon_a = \varepsilon_g + \varepsilon_s \qquad \text{Equation 1}$$

$$= [(N_p - N_{qd}\pi^2)\cdot n_r]\left\{D^3\left[\frac{\left(\frac{D^3 b}{\delta(D+\delta)}\right) + \frac{\pi^2 n_s^2 d^3(d+4\ell)}{4N_{qd}\left[n_s\cdot d^2 + 4\delta(D+\delta)\right]}}{}\right]\right\}\left(\frac{N^4\cdot t_m}{V}\right)$$

$$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b:Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer.

9. A rotor/stator type mixer comprising a mixer unit that includes a stator having a plurality of openings formed thereon and a rotor disposed inwardly radially of the stator and spaced away from the stator with a specific gap, wherein the rotor disposed inwardly radially of the stator and spaced away from the stator with the specific gap includes:

a rotor peripheral wall that is supported by a plurality of agitating blades extending radially from the center point of a rotary shaft of the rotor and faces opposite the inside of the peripheral wall of the stator having the plurality of openings formed thereon and is located inwardly radially of the stator with the specific gap; and a plurality of rotor openings formed on the rotor peripheral wall;

wherein the mixer can be scaled up or scaled down by calculating the Equation 1 listed below to estimate the mixer's particular running time and the resulting liquid drop diameters that can be obtained during that mixer's particular running time:

$$\varepsilon_a = \varepsilon_g + \varepsilon_s \qquad \text{Equation 1}$$

$$= [(N_p - N_{qd}\pi^2)\cdot n_r]\left\{D^3\left[\left(\frac{D^3 b}{\delta(D+\delta)}\right) + \frac{\pi^2 n_s^2 d^3(d+4\ell)}{4N_{qd}\left[\begin{matrix} n_s\cdot d^2 + \\ 4\delta(D+\delta)\end{matrix}\right]}\right]\right\}\left(\frac{N^4\cdot t_m}{V}\right)$$

$$= [(N_p - N_{qd}\pi^2)\cdot n_r]\cdot[D^3(K_g + K_s)]\cdot\left(\frac{N^4\cdot t_m}{V}\right)$$

$$= K_c\cdot\left(\frac{N^4\cdot t_m}{V}\right)$$

In the Equation 1, $\epsilon_a$: Total energy dissipation rate ($m^2/s^3$)

$\epsilon_g$: Local shear stress in the gap between the rotor and stator ($m^2/s^3$)

$\epsilon_s$: Local energy dissipation rate in the stator ($m^2/s^3$)

$N_p$: Number of powers (–)

Nqd: Number of flow rates (–)

$n_r$: Number of rotor blades (–)

D: Diameter of rotor (m)

b: Thickness of rotor blade tip (m)

δ: Gap between rotor and stator (m)

$n_s$: Number of stator holes (–)

d: Diameter of stator hole (m)

l: Thickness of stator (m)

N: Number of rotations (l/s)

$t_m$: Mixing time (s)

V: Flow rate ($m^3$)

$K_g$: Configuration dependent term ($m^2$)

$K_s$ Configuration dependent term in stator ($m^2$)

$K_c$: Configuration dependent term for the entire mixer.

10. A rotor/stator type mixer as defined in claim 9, wherein the stator includes a plurality of stators each having a different peripheral diameter and wherein the rotor peripheral wall of the rotor disposed inwardly radially of each of the stators is disposed so that it can be spaced away from each of the stators with a respective specific gap.

11. A rotor/stator type mixer as defined in claim 9, wherein the stator and the rotor are provided so that they can be brought closer to or farther away from each other in the direction in which the rotary shaft of the rotor extends.

12. A rotor/stator type mixer as defined in claim 9, wherein the stator has an annular cover extending inwardly radially from an edge of a top end edge.

13. A rotor/stator type mixer as defined in claim 12, wherein the annular cover has an inlet hole through which a fluid being processed can be introduced downwardly.

14. A rotor/stator type mixer as defined in claim 9, wherein each of the plurality of openings formed on the stator has a round shape.

15. A rotor/stator type mixer as defined in claim 9, wherein the plurality of openings formed on the stator represent over 20% of the total peripheral wall of the stator when it is expressed in terms of the opening-to-area ratio.

* * * * *